US010261432B2

(12) United States Patent
Kabata et al.

(10) Patent No.: US 10,261,432 B2
(45) Date of Patent: Apr. 16, 2019

(54) ESTER WAX, TONER, DEVELOPER, TONER STORING UNIT, AND IMAGE FORMING APPARATUS

(71) Applicants: Toshiyuki Kabata, Kanagawa (JP); Hiroyuki Shimada, Tokyo (JP); Takeshi Shibuya, Shizuoka (JP)

(72) Inventors: Toshiyuki Kabata, Kanagawa (JP); Hiroyuki Shimada, Tokyo (JP); Takeshi Shibuya, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/451,539

(22) Filed: Mar. 7, 2017

(65) Prior Publication Data

US 2017/0261876 A1 Sep. 14, 2017

(30) Foreign Application Priority Data

Mar. 11, 2016 (JP) ..... 2016-047960
Feb. 15, 2017 (JP) ..... 2017-026217

(51) Int. Cl.
*G03G 9/087* (2006.01)
*G03G 15/20* (2006.01)

(52) U.S. Cl.
CPC ..... *G03G 9/08782* (2013.01); *G03G 15/2014* (2013.01)

(58) Field of Classification Search
CPC ..... G03G 9/08782; G03G 15/0865
See application file for complete search history.

(56) References Cited

U.S. PATENT DOCUMENTS

2001/0044062 A1 11/2001 Kabata et al.
2002/0018947 A1 2/2002 Kabata et al.
2002/0160287 A1 10/2002 Miyamoto et al.
2003/0035661 A1 2/2003 Kabata et al.
2003/0129511 A1 7/2003 Kabata et al.
2003/0138711 A1 7/2003 Kabata et al.
2003/0175606 A1 9/2003 Kabata et al.
2003/0219296 A1 11/2003 Kabata et al.
2004/0151997 A1 8/2004 Miyamoto et al.
2005/0031377 A1 2/2005 Kabata et al.
2005/0069357 A1 3/2005 Kabata et al.
(Continued)

FOREIGN PATENT DOCUMENTS

EP 0686880 A1 * 5/1995 ..... G03C 9/087
JP 2009-092864 4/2009
(Continued)

OTHER PUBLICATIONS

U.S. Appl. No. 15/289,439, filed Oct. 10, 2018.
(Continued)

*Primary Examiner* — Thorl Chea
(74) *Attorney, Agent, or Firm* — Oblon, McClelland, Maier & Neustadt, L.L.P.

(57) ABSTRACT

An ester wax is provided. The ester wax includes a long-chain aliphatic ester represented by the following formula:

R—COO—R' wherein R represents an alky group having 13 to 23 carbon atoms and R' represents an alkyl group having 18 to 22 carbon atoms. The ester wax further includes an aliphatic alcohol having 18 to 22 carbon atoms in an amount less than 3% by mass based on a total mass of the ester wax.

12 Claims, 5 Drawing Sheets

(56) References Cited

U.S. PATENT DOCUMENTS

| | | | |
|---|---|---|---|
| 2005/0141917 | A1 | 6/2005 | Enoki et al. |
| 2005/0232658 | A1 | 10/2005 | Kabata et al. |
| 2005/0276632 | A1 | 12/2005 | Ariizumi et al. |
| 2006/0063079 | A1 | 3/2006 | Miyamoto et al. |
| 2006/0165443 | A1 | 7/2006 | Yoshinaga et al. |
| 2006/0177232 | A1 | 8/2006 | Ehara et al. |
| 2006/0257183 | A1 | 11/2006 | Ehara et al. |
| 2006/0269323 | A1 | 11/2006 | Kabata et al. |
| 2007/0104512 | A1 | 5/2007 | Hatakeyama et al. |
| 2007/0110488 | A1 | 5/2007 | Kabata et al. |
| 2008/0019737 | A1 | 1/2008 | Kabata et al. |
| 2008/0089726 | A1 | 4/2008 | Hatakeyama et al. |
| 2008/0226365 | A1 | 9/2008 | Hatakeyama et al. |
| 2008/0253801 | A1 | 10/2008 | Hatakeyama et al. |
| 2009/0003853 | A1 | 1/2009 | Hatakeyama et al. |
| 2009/0016769 | A1 | 1/2009 | Hatakeyama et al. |
| 2009/0028618 | A1 | 1/2009 | Kabata et al. |
| 2009/0232541 | A1 | 9/2009 | Hatakeyama et al. |
| 2009/0274477 | A1 | 11/2009 | Okamoto et al. |
| 2009/0274494 | A1 | 11/2009 | Okamoto et al. |
| 2009/0274495 | A1 | 11/2009 | Okamoto et al. |
| 2009/0274496 | A1 | 11/2009 | Okamoto et al. |
| 2009/0274497 | A1 | 11/2009 | Okamoto et al. |
| 2009/0274498 | A1 | 11/2009 | Okamoto et al. |
| 2009/0279930 | A1 | 11/2009 | Kabata et al. |
| 2009/0290920 | A1 | 11/2009 | Hatakeyama et al. |
| 2010/0034570 | A1 | 2/2010 | Hatakeyama et al. |
| 2010/0178073 | A1 | 7/2010 | Kabata et al. |
| 2010/0196062 | A1 | 8/2010 | Kozasa et al. |
| 2011/0052928 | A1 | 3/2011 | Shionoiri et al. |
| 2011/0085824 | A1 | 4/2011 | Hatakeyama et al. |
| 2011/0129269 | A1 | 6/2011 | Seo et al. |
| 2011/0129270 | A1 | 6/2011 | Seo et al. |
| 2011/0135361 | A1 | 6/2011 | Kabata et al. |
| 2012/0308260 | A1 | 12/2012 | Kabata et al. |
| 2013/0149017 | A1 | 6/2013 | Amita et al. |
| 2013/0170882 | A1 | 7/2013 | Shimada et al. |
| 2013/0188972 | A1 | 7/2013 | Kabata et al. |
| 2013/0243499 | A1* | 9/2013 | Ishikura ..... G03G 15/0812 399/284 |
| 2014/0016975 | A1 | 1/2014 | Shimada et al. |
| 2014/0023967 | A1 | 1/2014 | Kabata et al. |
| 2014/0119799 | A1 | 5/2014 | Kabata et al. |
| 2014/0255069 | A1 | 9/2014 | Iio et al. |
| 2014/0348496 | A1 | 11/2014 | Kabata et al. |
| 2015/0086255 | A1 | 3/2015 | Shimada et al. |
| 2015/0344804 | A1 | 12/2015 | Kabata et al. |
| 2015/0344809 | A1 | 12/2015 | Kabata et al. |
| 2015/0345614 | A1 | 12/2015 | Kabata et al. |

FOREIGN PATENT DOCUMENTS

| | | |
|---|---|---|
| JP | 2011-169968 | 9/2011 |
| JP | 2013-050589 | 3/2013 |
| JP | 2014-077988 | 5/2014 |

OTHER PUBLICATIONS

Norikazu Namiki, et al., "A Field Study on Chracaterization Semivolatile Oragnic Compounds in Indoor Environment—Partitioning of them in gaseous phase and particulate phases for airborne and settled dusts—", *Journal of Housing Research Foundation*, 37 (Tokyo, 2010), pp. 215-224. ( with English Abstract).

* cited by examiner

ESTER WAX, TONER, DEVELOPER, TONER STORING UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2016-047960 and 2017-026217, filed on Mar. 11, 2016 and Feb. 15, 2017, respectively, in the Japan Patent Office, the entire disclosure of each of which is hereby incorporated by reference herein.

BACKGROUND

Technical Field

The present disclosure relates to an ester wax, a toner, a developer, a toner storing unit, and an image forming apparatus.

Description of the Related Art

An electrophotographic image forming apparatus is generally equipped with a fixing device that fixes a toner image on a medium (e.g., paper sheet) by heat.

Lately, in place of conventional oil fixing devices that have a silicone oil coating for preventing toner from fixedly adhering thereto, oilless fixing devices are widely used in combination with wax-containing toners. The wax in the toner is melted when the toner is fixed on a medium, thus preventing the toner from adhering to the surface of the fixing device. Oilless fixing devices are much simpler than oil fixing devices in configuration and free from a silicone oil contamination problem.

As the wax in the toner, hydrocarbon waxes (e.g., polyethylene wax, paraffin wax), aliphatic alcohols, synthetic polyester waxes, natural waxes composed primarily of ester waxes (e.g., carnauba wax), and mixtures thereof, have been used.

Environmental issues are attracting high interest all over the world. There are various accreditation criteria for volatile organic compounds (VOC), ozone, dust, fine particles, and ultrafine particles particularly generated in electrophotographic image forming processes performed by copiers, multifunction peripherals, or printers. For example, the Blue Angel Mark is known as a German ecolabel for products and services that have environmentally friendly aspects.

Any product without the Blue Angel Mark certification is available for sale, but such a product is likely considered to be environmentally unfriendly, especially by government offices. Thus, the Blue Angle Mark certification has a significant influence on product sales.

Certification criteria for the Blue Angel Mark include the dust criterion. According to the dust criterion, the amount of dust is required to be less than 4 mg/h. Here, the amount of dust is determined by operating an image forming apparatus in a sealed chamber, sucking the air from the chamber through a quartz filter, and measuring the increased mass of the quartz filter. Dust generated from the image forming apparatus generally contains a wax included in toner. In a case in which the toner includes a paraffin wax that expresses a relatively high saturated vapor pressure even at a temperature lower than the boiling point, disadvantageously, the paraffin wax will vaporize when the toner is fixed on a medium and adhere to the quartz filter.

By contrast, in a case in which the toner includes an ester wax that expresses an extremely low vapor pressure at a fixing temperature, the amount of generated dust will be very little, which is preferable. In view of this situation, toners containing an ester wax only, as well as toners containing both an ester wax and a paraffin wax, have been proposed.

The fine particle and ultrafine particle criterion have been added to the Blue Angel Mark.

The Blue Angel Mark (RAL-UZ 171, revised in January 2013) defines fine particles and ultrafine particles as particles measurable by a particle size measuring instrument having a measurable particle diameter range of from 7 to 300 nm.

The Blue Angel Mark criterion requires that the number of fine particles and ultrafine particles generated during a 10-minute operation of an image forming apparatus be less than $3.5\times10^{11}$/10 min. The Blue Angel Mark criterion concerns neither the substance nor the total mass of fine particle and ultrafine particles, and does concern only the number of fine particles and ultrafine particles measured by the particle size measuring instrument. The rate of generation of fine particles and ultrafine particles has no relation to the image forming speed of the image forming apparatus. According to the Blue Angel Mark, the rate of generation of fine particles and ultrafine particles is determined from the amount of fine particles and ultrafine particles generated while the image forming apparatus is in continuous operation for 10 minutes.

A widely-used particle size measuring instrument Fast Mobility Particle Sizer (FMPS) can measure particles having a particle diameter of from 5.6 to 560 nm. Thus, particles which are measurable by the FMPS are included in the fine particles and ultrafine particles defined by the Blue Angel Mark. In the present disclosure, among fine particles and ultrafine particles generated during a 10-minute operation of an image forming apparatus, particles having a particle diameter of from 5.6 to 560 nm when measured by FMPS are defined as UFP.

UFP may be generated from various parts in the image forming apparatus. In particular, it has already been confirmed that the fixing device is the main cause of generation of UFP, based on an experimental result that the UFP concentration is drastically increased when only the fixing device is put into operation. As an example, it has been confirmed that UFP may include siloxane generated from a rubber layer included in a fixing member (e.g., roller, belt).

As another example, it has been confirmed that UFP may include substances included in toner. This is based on the fact that the amount of UFP generated during formation of an image used for a certification criteria test of the Blue Angel Mark becomes nearly 1.5 to 5 times that during formation of a blank white image. This indicates that UFP generated during the image formation contains substances generated from toner. Thus, to suppress generation of UFP from an image forming apparatus, generation of UFP from toner should be suppressed.

It has already been reported that there is a case in which a paraffin wax included in toner becomes UFP.

SUMMARY

In accordance with some embodiments of the present invention, an ester wax is provided. The ester wax includes a long-chain aliphatic ester represented by the following formula:

$$R—COO—R'$$

wherein R represents an alky group having 13 to 23 carbon atoms and R' represents an alkyl group having 18 to 22 carbon atoms. The ester wax further includes an aliphatic alcohol having 18 to 22 carbon atoms in an amount less than 3% by mass based on a total mass of the ester wax.

In accordance with some embodiments of the present invention, a toner is provided. The toner includes the above ester wax.

In accordance with some embodiments of the present invention, a developer is provided. The developer includes the above toner.

In accordance with some embodiments of the present invention, a toner storing unit is provided. The toner storing unit includes a storing unit and the above toner stored in the storing unit.

In accordance with some embodiments of the present invention, an image forming apparatus is provided. The image forming apparatus includes an electrostatic latent image bearer, an electrostatic latent image forming device, and a developing device. The electrostatic latent image forming device is configured to form an electrostatic latent image on the electrostatic latent image bearer. The developing device contains the above developer and is configured to develop the electrostatic latent image formed on the electrostatic latent image bearer into a toner image with the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
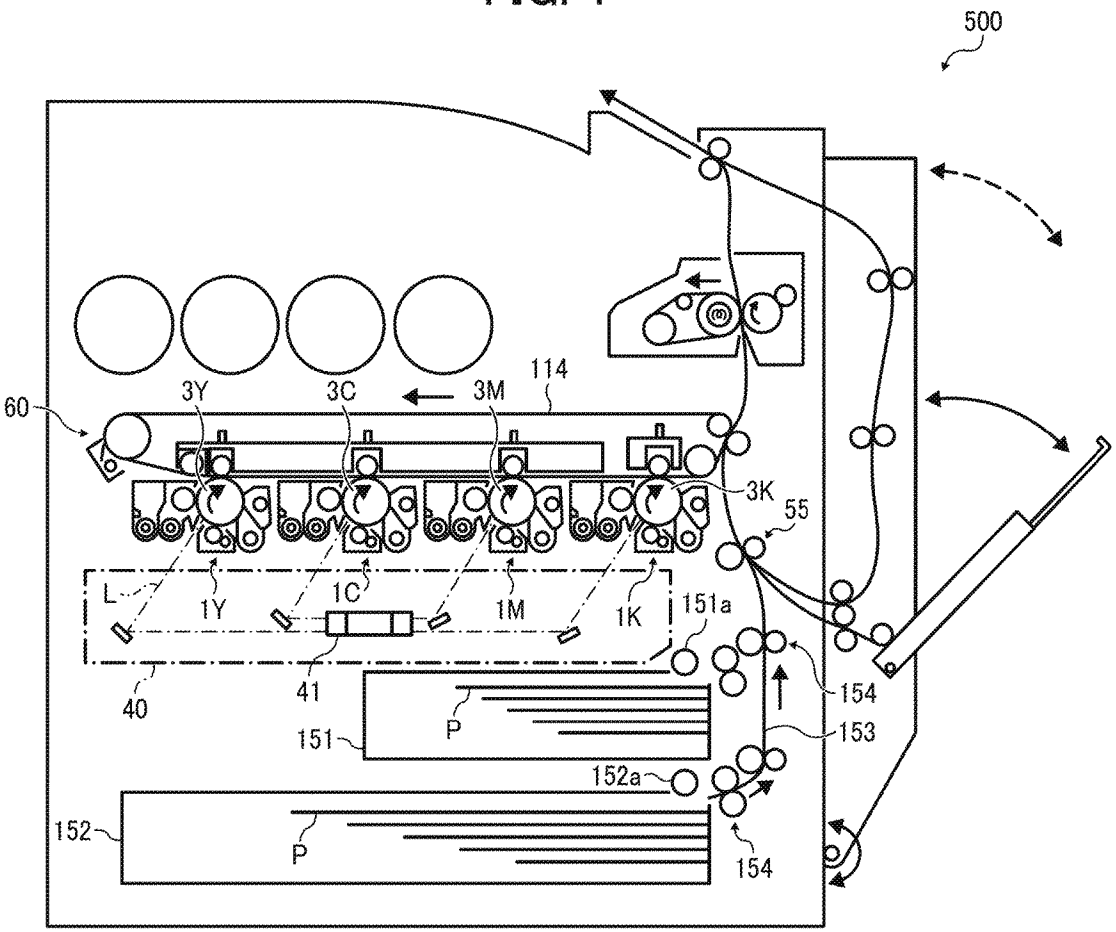
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an ester wax is provided that produces very few UFP when included in toner.

As described above, a paraffin wax vaporizes in large amounts when heated. Therefore, it is natural that the paraffin wax becomes UFP when included in toner. On the other hand, even in a case in which toner contains an ester wax that will generate very little dust, a larger number of UFP are generated during image formation, especially when the fixing temperature is relatively high.

The inventors of the present invention analyzed total volatile organic compounds (TVOC) generated from an image forming apparatus that uses an ester-wax-containing toner, to determine the composition of UFP generated from the image forming apparatus. However, the composition of UFP did not become clear. This is because the amount of generation of UFP is extremely smaller than that of TVOC. In particular, while the generated amount of UFP is several micro-gram order, the mass of TVOC is several hundred to several hundred thousand times that of generated UFP.

As one method for separating UFP from TVOC gaseous components, a method for collecting UFP with a diffusion tube has been proposed (Namiki, Norikazu. "A Field Study om Characterization Semivolatile Organic Compounds in Indoor Environment—Partitioning of them in gaseous phase and particulate phase for airborne and settled dusts—", Journal of Housing Research Foundation, No. 37, 2010, pp. 215-224).

Thus, the inventors of the present invention collected UFP generated from the image forming apparatus using a diffusion tube and analyzed the collected UFP. As a result, not only siloxane (conventionally known as UFP components) but also aliphatic alcohols were detected. In particular, UFP was analyzed each time the area of an image produced by the image forming apparatus was changed. As a result, the detected amount of aliphatic alcohols was increased as the image area was increased, while the detected amount of siloxane was changed very little. This indicates that the aliphatic alcohols in UFP were originally included in toner.

For confirmation, the inventors of the present invention analyzed UFP that were collected when the toner was heated alone. As a result, aliphatic alcohols were detected. Furthermore, the inventors of the present invention analyzed UFP that were collected when each component of the toner was heated alone. As a result, it was confirmed that aliphatic alcohols were detected from an ester wax.

Ester waxes vaporize very little even when being heated, as described above. Thus, an ester wax may generate very few UFP at around 160° C., i.e., at around a toner fixing temperature. The inventors of the present invention have found that, however, an ester wax generates UFP consisting of aliphatic alcohols, not UFP consisting of the ester wax itself, when heated to 190-200° C. Although the temperatures of 190-200° C. are very lower than the boiling point of aliphatic alcohols, aliphatic alcohols vaporize with a very small vapor pressure at that temperature and condensate immediately thereafter, thus becoming UFP.

The inventors of the present invention have found out the reason why aliphatic alcohols are included in the ester wax. The detected aliphatic alcohols were found to be those unreacted in the process of producing the ester wax by reacting aliphatic acids with aliphatic alcohols. Since aliphatic alcohols are less active than aliphatic acids and able to function as a wax for toner, the unreacted aliphatic alcohols remaining in the ester wax exert no influence on the property of the ester wax. Thus, the aliphatic alcohols have not been removed from the ester wax from the aspects of both property and production cost.

A temperature at which explosive generation of UFP of aliphatic alcohols from the ester wax starts is higher than the toner fixing temperature. On the other hand, a roller and a belt in the fixing device each have an area larger than that of a paper sheet on which the toner is to be fixed. Specific parts of the roller and the belt that will come into contact with the paper sheet are accurately temperature-controlled. However, end parts of the roller and belt that will not contact toner are excessively increased in temperature. Since aliphatic alcohols express high fluidity at high temperatures, they migrate to the end parts of the roller and belt to become UFP. When the fixing device is started up, part of the roller and belt other than the fixing nip part are heated to a temperature at which UFP can generate, to quickly raise the fixing nip temperature. There is a case in which the image forming apparatus performs a process control between image forming operations for determining whether the image forming operation is properly performed. It has been confirmed that UFP generates during such a process control, since no paper sheet passes through the fixing nip and the temperature of the roller and the belt becomes higher.

The inventors of the present invention have found that, to clear the UFP criterion of the Blue Angel Mark, the concentration of aliphatic alcohols should be controlled to be equal to or less than a certain value.

The toner according to an embodiment of the present invention includes an ester wax that includes a long-chain aliphatic ester represented by the formula R—COO—R', where R represents an alkyl group having 13 to 23 carbon atoms and R' represents an alkyl group having 18 to 22 carbon atoms. The ester wax may be either a natural ester wax or a synthetic ester wax. However, natural ester waxes generally include a large amount of impurities that may become UFP. For this reason, synthetic ester waxes are more preferred than natural ester waxes.

Specifically, synthetic ester waxes that show an endothermic peak within a temperature range of from 65° C. to 75° C., preferably from 70° C. to 75° C., when analyzed by a differential scanning calorimeter (DSC), are preferable. When the endothermic peak is observed at 65° C. or higher, the toner is less likely to cause blocking when stored, thus preventing deterioration of heat-resistant storage stability. In addition, when the endothermic peak is observed at 65° C. or higher, the amount of volatilization of the wax does not increase, thus preventing contamination of the inside of the image forming apparatus. When the endothermic peak is observed at 75° C. or lower, low-temperature fixability does not deteriorate.

The endothermic peak of the ester wax in a toner can be determined by a measurement performed by a differential scanning calorimeter (DSC). In the present disclosure, the measurement is performed by a differential scanning calorimeter DSC-60 (available from Shimadzu Corporation). In the measurement, a sample is heated to 20° C.-150° C. at a heating rate of 10° C./min, for determining endothermic peak and glass transition temperature (Tg).

A synthetic ester wax according an embodiment of the present invention may be produced by an esterification reaction between a straight-chain fatty acid an aliphatic alcohol. The esterification reaction may be performed at 150° C.-260° C. in the absence of solvent or at 50° C.-180° C. in the presence of a catalyst and a solvent, but the reaction condition is not limited thereto. Specific examples of usable catalysts include, but are not limited to, typical acid catalysts such as para-toluene sulfonic acid, sulfuric acid, hydrochloric acid, methanesulfonic acid, boron trifluoride—diethyl ether complex, titanium alcoholate, and solid acid catalysts. Specific examples of usable solvents include, but are not limited to, toluene and heptane. In addition, a refining process, such as decolorization, deoxidation, reduced-pressure distillation, water washing, deodorizing by steam distillation, activated carbon treatment, may follow the esterification reaction.

Specific examples of the straight-chain fatty acid for synthesizing the ester wax include, but are not limited to, fatty acids having 14 to 24 carbon atoms, such as myristic acid, palmitic acid, stearic acid, arachidic acid, behenic acid, and lignoceric acid.

Specific examples of the aliphatic alcohol for synthesizing the ester wax include, but are not limited to, aliphatic alcohols having 18 to 22 carbon atoms, such as stearyl alcohol, eicosanol, and behenyl alcohol.

A synthetic ester wax containing a less amount of aliphatic alcohols having 18 to 22 carbon atoms may be obtained by an esterification reaction between a straight-chain fatty acid and an equimolar amount of an aliphatic alcohol having 18 to 22 carbon atoms. In the case of producing such a synthetic ester wax in large amounts, the straight-chain fatty acid may become locally excessive and remain in the resulting ester wax. To avoid this, preferably, the esterification reaction is performed between an aliphatic alcohol and a fatty acid with the amount of the aliphatic alcohol being larger than that of the fatty acid, and followed by a refining process for removing the aliphatic alcohol.

Although synthetic ester waxes generally include less impurity than natural ester waxes, commercially-available synthetic ester waxes containing the ester represented by the above formula include aliphatic alcohols having 18 to 22 carbon atoms as impurities. The amount of aliphatic alcohols having 18 to 22 carbon atoms included as impurities is sufficient for generating UFP. Thus, such synthetic ester waxes need to be refined. Preferably, the content rate of aliphatic alcohols having 18 to 22 carbon atoms in the ester wax is 3% by mass or less, more preferably 1.8% by mass or less, and most preferably in the range of from 0.1% to 1.2% by mass. When the concentration of aliphatic alcohols having 18 to 22 carbon atoms is 3% by mass or more, the amount of generation of UFP from the image forming apparatus may increase, which is not preferable in terms of the Blue Angel Mark certification.

Preferably, the concentration of aliphatic alcohols having 18 to 22 carbon atoms in the synthetic ester wax is as small as possible, under the assumption that UFP to be generated includes the aliphatic alcohols only. In actual, however, UFP generated from the image forming apparatus contains siloxane, generated from silicone rubbers in the fixing device, other than the aliphatic alcohols. Since the melting point of siloxane is lower than that of aliphatic alcohols, it takes a certain amount of time until the vaporized siloxane condensates to grow into UFP, and most of the grown UFP is very small in particle diameter. Such UFP of siloxane having a very small particle diameter becomes large in number, which does not meet the criterion of the Blue Angel Mark that is based on the number of UFP.

On the other hand, siloxane likely adsorbs to the stabilized aliphatic alcohols having 18 to 22 carbon atoms that have undergone vaporization and condensation immediately thereafter. Therefore, the total number of UFP can be more reduced when an extremely small amount of aliphatic alcohols having 18 to 22 carbon atoms exists. Generally, when the concentration of aliphatic alcohols having 18 to 22 carbon atoms in the synthetic ester wax is about 0.1% by mass or more, the number of UFP of siloxane is reduced, depending on the concentration of siloxane. The synthetic wax is subjected to a refining process in consideration of cost and effect. When the concentration of aliphatic alcohols having 18 to 22 carbon atoms in the synthetic wax is 3% by mass or more, the number of UFP consisting of aliphatic alcohols becomes large, which does not meet the criterion of the Blue Angel Mark.

It is possible to completely eliminate aliphatic alcohols by adjusting the formulation of the ester wax to be synthesized, or removing them after the ester wax has been synthesized. In a case in which aliphatic alcohols are eliminated from the formulation, it is very likely that fatty acids remain in the synthesized ester wax instead of the aliphatic alcohols. If such an ester wax is used for a toner, the toner may have poor storage stability. In addition, a process for removing aliphatic alcohols is so complicated that it takes a long time to remove aliphatic alcohols, resulting in cost rise.

As a method for making the concentration of aliphatic alcohols having 18 to 22 carbon atoms in the ester wax less than 3% by mass, the following methods have been proposed: a solvent extraction method; and a method of vaporizing aliphatic alcohols having 18 to 22 carbon atoms by heating the ester wax under atmospheric or reduced pressure. From the aspects of removal efficiency of the aliphatic alcohols having 18 to 22 carbon atoms and prevention of oxidation of the ester wax, the latter method is more preferable. Specifically, a vacuum distillation method is most preferable. In a vacuum distillation method, a trap (e.g., dry ice, liquid nitrogen) may be used for more effectively removing aliphatic alcohols having 18 to 22 carbon atoms from the ester wax.

Preferably, the toner according to some embodiments of the present invention has an average circularity of from 0.930 to 1.00, more preferably from 0.950 to 0.990. The average circularity is an average in circularity SR, defined by the following formula (1), among toner particles. The circularity indicates the degree of irregularity of a toner particle. A toner particle in a perfectly spherical shape has a circularity of 1.00. As the surface profile of a toner particle becomes more complicated, the circularity becomes smaller.

Circularity SR=(Peripheral length of a circle having the same area as a projected image of a toner particle)/(Peripheral length of the projected image of the toner particle) Formula (1)

Toner particles having an average circularity of from 0.930 to 1.00 have smooth surfaces. Such toner particles provide excellent transferability since the contact area between the toner particles and that between each toner particle and a photoconductor are small. Since such toner particles are not angular, a stirring torque in a developing device is small. Thus, the toner particles can be stably stirred and produce no abnormal image. In transferring dots onto a recording medium with pressure, the pressure is uniformly applied to all the toner particles forming the dots, since no angular toner particle exists in the dots. Thus, the dots can be reliably transferred onto the recording medium without causing detective transfer. Such non-angular toner particles have a small abrasive force and therefore neither damages nor wears the surface of an image bearer.

The circularity SR can be measured with a flow particle image analyzer (FPIA-1000, a product of Toa Medical Electronics Co., Ltd.) in the following manner.

First, 0.1 to 0.5 ml of a surfactant (preferably an alkylbenzene sulfonate), serving as a dispersant, is added to 100 to 150 ml of water from which solid impurities have been removed, and 0.1 to 0.5 g of toner particles are further added thereto. Next, the resulting suspension liquid of the toner particles is subjected to a dispersion treatment using an ultrasonic disperser for about 1 to 3 minutes. After adjusting the concentration of the toner particles to 3,000 to 10,000 particles/μl, the suspension liquid is subjected to a measurement of shape and size of the toner particles using the above-described instrument.

Preferably, the toner has a mass average particle diameter (D4) of from 3 to 10 μm, more preferably from 4 to 8 μm. When D4 is within the above range, the toner contains toner particles that are small enough for forming micro dots of a latent image, thus providing excellent dot reproducibility. When D4 is less than 3 μm, transfer efficiency and/or blade cleaning ability of the toner may deteriorate. When D4 is greater than 10 μm, it may be difficult to suppress the occurrence of toner scattering in text and line images.

Preferably, a ratio (D4/D1) of the mass average particle diameter (D4) to the number average particle diameter (D1) of the toner is in the range of from 1.00 to 1.40, more preferably from 1.00 to 1.30. As D4/D1 approaches 1, the particle size distribution of the toner becomes narrower. When D4/D1 is within the range of from 1.00 to 1.40, the toner continuously provides high image quality since selective development (depending on the toner particle size) does not occur. When D4/D1 is within the above range, the particle size distribution of the toner is narrow, and therefore the triboelectric charge amount distribution is also narrow, thus suppressing the occurrence of fogging. When D4/D1 is within the above range, the toner particles are almost uniform in particle size. Such toner particles develop dots of a latent image with an excellent dot reproducibility, by being tightly arranged in an orderly manner.

The mass average particle diameter (D4) and the particle size distribution of the toner can be measured by a Coulter counter method. The Coulter counter method can be performed by instruments such as COULTER COUNTER TA-II and COULTER MULTISIZER II (products of Beckman Coulter Inc.) in the following manner.

First, 0.1 to 5 ml of a surfactant (preferably an alkylbenzene sulfonate), as a dispersant, is added to 100 to 150 ml of an electrolyte solution. Here, the electrolyte solution is an about 1% NaCl aqueous solution prepared with the first grade sodium chloride. As the electrolyte solution, for example, ISOTON-II (available from Beckman Coulter, Inc.) can be used. Next, 2 to 20 mg of toner particles are further added to the electrolyte solution. The electrolyte solution in which the toner particles are suspended is subjected to a dispersion treatment using an ultrasonic disperser for about 1 to 3 minutes, and thereafter to a measurement of volume and number of the toner particles using the above-described instrument equipped with a 100-μm aperture to calculate volume and number distributions. The mass average particle diameter (D4) and number average particle diameter (D1) are determined from the calculated volume and number distributions.

Thirteen channels with the following ranges are used for the measurement: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm;

8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Thus, particles having a particle diameter of 2.00 or more and less than 40.30 μm are to be measured.

Such an approximately spherical toner can be prepared by subjecting a toner composition, containing a polyester prepolymer having a nitrogen-containing functional group, a polyester, a colorant, and a release agent, to a cross-linking reaction and/or an elongation reaction in an aqueous medium in the presence of a fine resin particle. The above-prepared toner is suppressed from undergoing hot offset as the surface is hardened. Thus, the toner is suppressed from contaminating a fixing device and depositing on an image.

Examples of the polyester prepolymer having a nitrogen-containing functional group include a polyester prepolymer (A) having an isocyanate group. Examples of compounds that elongate or cross-link with the prepolymer include an amine (B).

Examples of the polyester prepolymer (A) having an isocyanate group include a reaction product of a polyester having an active hydrogen group with a polyisocyanate (3), where the polyester is a polycondensation product of a polyol (1) with a polycarboxylic acid (2). Examples of the active hydrogen group of the polyester include hydroxyl groups (e.g., alcoholic hydroxyl groups, phenolic hydroxyl groups), amino groups, carboxyl group, and mercapto group. Among these groups, alcoholic hydroxyl groups are most preferable.

The polyol (1) may be, for example, a diol (1-1) or a polyol (1-2) having 3 or more valences. Sole use of a diol (1-1) or a combination use of a diol (1-1) with a small amount of a polyol (1-2) having 3 or more valences is preferable.

Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the above alicyclic diols; and alkylene oxide (e.g., ethylene oxide, propylene oxide, butylene oxide) adducts of the above bisphenols. Among these compounds, alkylene glycols having 2 to 12 carbon atoms and alkylene oxide adducts of bisphenols are preferable, and combinations of alkylene oxide adducts of bisphenols with alkylene glycols having 2 to 12 carbon atoms are more preferable.

Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the above polyphenols having 3 or more valences.

The polycarboxylic acid (2) may be, for example, a dicarboxylic acid (2-1) or a polycarboxylic acid (2-2) having 3 or more valences. Sole use of a dicarboxylic acid (2-1) or a combination use of a dicarboxylic acid (2-1) with a small amount of a polycarboxylic acid (2-2) having 3 or more valences is preferable.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these compounds, alkene dicarboxylic acids having 4 to 20 carbon atoms and aromatic dicarboxylic acids having 8 to 20 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (2).

Preferably, the equivalent ratio [OH]/[COOH] of hydroxyl groups [OH] in the polyol (1) to carboxyl groups [COOH] in the polycarboxylic acid (2) is from 2/1 to 1/1, more preferably from 1.5/1 to 1/1, and most preferably from 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, and the above polyisocyanates that have been blocked with phenol derivatives, oxime, or caprolactam. Each of these compounds can be used alone or in combination with others.

Preferably, the equivalent ratio [NCO]/[OH] of isocyanate groups [NCO] in the polyisocyanate (3) to hydroxyl groups [OH] in the polyester having a hydroxyl group is from 5/1 to 1/1, more preferably from 4/1 to 1.2/1, and most preferably from 2.5/1 to 1.5/1. When the ratio [NCO]/[OH] is in excess of 5, low-temperature fixability may deteriorate. When the molar ratio of [NCO] is less than 1, the urea content in the modified polyester is lowered to degrade hot offset resistance.

Preferably, the content of the polyisocyanate (3) components in the polyester prepolymer (A) having an isocyanate group is from 0.5% to 40% by mass, more preferably from 1% to 30% by mass, and most preferably from 2% to 20% by mass. When the content is less than 0.5% by mass, hot offset resistance may deteriorate, becoming disadvantageous in terms of achievement of a good balance between heat-resistant storage stability and low-temperature fixability. When the content is in excess of 40% by mass, low-temperature fixability may deteriorate.

Preferably, the number of isocyanate groups included in one molecule of the polyester prepolymer (A) having an isocyanate group is 1 or more, more preferably from 1.5 to 3, and most preferably from 1.8 to 2.5, in average. When the number of isocyanate groups per molecule is less than 1, the molecular weight of the resulting urea-modified polyester (i) is lowered to degrade hot offset resistance.

The amine (B) may be, for example, a diamine (B1), a polyamine (B2) having 3 or more valences, an amino alcohol (B3), an amino mercaptan (B4), an amino acid (B5), or a blocked amine (B6) that is one of the amines (B1) to (B5) the amino group of which has been blocked. Specific examples of the diamine (B1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. Among these amines, the diamine (B1) alone, and a mixture of the diamine (B1) with a small amount of the polyamine (B2) are preferable.

The molecular weight of the urea-modified polyester (i) may be adjusted using an elongation terminator, if needed. Specific examples of the elongation terminator include, but are not limited to, monoamines (e.g., diethylamine, dibutylamine, butylamine, laurylamine) and blocked monoamines (e.g., ketimine compounds).

Preferably, the equivalent ratio [NCO]/[NHx] of isocyanate groups in the prepolymer (A) having an isocyanate group to amino groups [NHx] in the amine (B) is from 1/2 to 2/1, more preferably from 1.5/1 to 1/1.5, and most preferably from 1.2/1 to 1/1.2. When the equivalent ratio [NCO]/[NHx] is in excess of 2 or less than 1/2, the molecular weight of the urea-modified polyester (i) is lowered to degrade hot offset resistance.

The urea-modified polyester may include urethane bonds along with urea bonds. Preferably, the molar ratio of the content of urea bonds to that of urethane bonds is from 100/0 to 10/90, more preferably from 80/20 to 20/80, and most preferably from 60/40 to 30/70. When the molar ratio of urea bonds is less than 10%, hot offset resistance may deteriorate.

Through the above-described processes, the urea-modified polyester (i) is included in the toner. The urea-modified polyester (i) can be produced by a one shot method or a prepolymer method. Preferably, the urea-modified polyester (i) has a mass average molecular weight of 10,000 or more, more preferably from 20,000 to 10,000,000, and most preferably from 30,000 to 1,000,000. When the mass average molecular weight is less than 10,000, hot offset resistance may deteriorate.

The urea-modified polyester (i) is not limited in number average molecular weight when used in combination with an unmodified polyester (ii). The number average molecular weight of the urea-modified polyester (i) may be properly adjusted such that the mass average molecular weight thereof falls within the above-described range. When the urea-modified polyester (i) is used alone, preferably, the number average molecular weight thereof is 20,000 or less, more preferably from 1,000 to 10,000, and most preferably from 2,000 to 8,000. When the number average molecular weight is in excess of 20,000, low-temperature fixability and glossiness of the toner, particularly when the toner is used in a full-color image forming apparatus, may deteriorate.

As described above, the toner may include the urea-modified polyester (i) alone or a combination of the urea-modified polyester (i) with the unmodified polyester (ii), as binder resins. The combination of the urea-modified polyester (i) and the unmodified polyester (ii) more improves low-temperature fixability and glossiness of the toner, particularly when the toner is used in a full-color image forming apparatus, than the urea-modified polyester (i) alone. Specific examples of the unmodified polyester (ii) include polycondensation products of the above-described polyols (1) with the above-described polycarboxylic acids (2), used for preparing the urea-modified polyester (i). Materials preferably used for preparing the urea-modified polyester (i) are also preferably used for preparing the unmodified polyester (ii). Examples of the unmodified polyester (ii) include not only polyesters that have not been modified but also polyesters modified with a chemical bond other than urea bond such as urethane bond. Preferably, the urea-modified polyester (i) and the unmodified polyester (ii) are at least partially compatibilized with each other from the aspects of low-temperature fixability and hot offset resistance.

Accordingly, it is preferable that the polyester component of the urea-modified polyester (i) and the unmodified polyester (ii) have a similar composition. When the urea-modified polyester (i) and the unmodified polyester (ii) are used in combination, preferably, the mass ratio of the urea-modified polyester (i) to the unmodified polyester (ii) ranges from 5/95 to 80/20, more preferably from 5/95 to 30/70, much more preferably from 5/95 to 25/75, and most preferably from 7/93 to 20/80. When the mass ratio of the urea-modified polyester (i) is 5% by mass or more, hot offset resistance does not deteriorate, and a good balance between heat-resistant storage stability and low-temperature fixability is advantageously achieved.

Preferably, the unmodified polyester (ii) has a peak molecular weight of from 1,000 to 30,000, more preferably from 1,500 to 10,000, and most preferably from 2,000 to 8,000. When the peak molecular weight is 1,000 or more, heat-resistant storage stability does not deteriorate. When the peak molecular weight is 10,000 or less, low-temperature fixability does not deteriorate. Preferably, the unmodified polyester (ii) has a hydroxyl value of 5 or more, more preferably from 10 to 120, and most preferably from 20 to 80. When the hydroxyl value is 5 or more, it is disadvantageous in terms of achievement of a good balance between heat-resistant storage stability and low-temperature fixability. Preferably, the unmodified polyester (ii) has an acid value of from 1 to 30, and more preferably from 5 to 20. By giving the acid value within the above range to the toner, the toner becomes more negatively chargeable.

Preferably, the binder resin has a glass transition temperature (Tg) of from 50° C. to 70° C., and more preferably from 55° C. to 65° C. When the glass transition temperature is 50° C. or more, blocking property of the toner does not deteriorate even when the toner is stored at high temperatures. When the glass transition temperature is 70° C. or less, low-temperature fixability becomes sufficient. Since the urea-modified polyester (i) is included, the toner according to some embodiments of the present invention has better heat-resistant storage stability than conventional polyester-based toners although the glass transition temperature is low.

Preferably, a temperature (TG'), at which the storage elastic modulus of the binder resin becomes 10,000 dyne/$cm^2$ at a measurement frequency of 20 Hz, is 100° C. or more, more preferably from 110° C. to 200° C. When the temperature (TG') is 100° C. or more, hot offset resistance does not deteriorate.

Preferably, a temperature (Tη), at which the viscosity of the binder resin becomes 1,000 poise at a measurement frequency of 20 Hz, is 180° C. or less, more preferably from 90° C. to 160° C. When the temperature (Tη) is 180° C. or less, low-temperature fixability does not deteriorate. It is preferable that TG' is higher than Tη from the aspect of achievement of a good balance between low-temperature fixability and hot offset resistance. More specifically, preferably, the difference between TG' and Tη (i.e., TG'−Tη) is 0° C. or more, more preferably 10° C. or more, and most preferably 20° C. or more. There is no upper limit for the difference between TG' and Tη (i.e., TG'−Tη). It is preferable that the difference between Tη and Tg is from 0 to 100° C., more preferably from 10 to 90° C., and most preferably from 20 to 80° C., from the aspect of achievement of a good balance between heat-resistant storage stability and low-temperature fixability.

The binder resin may be produced in the following manner.

First, a polyol (1) and a polycarboxylic acid (2) are heated to between 150 and 280° C. in the presence of an esterification catalyst (e.g., tetrabutoxy titanate, dibutyltin oxide) while reducing pressure and removing by-product water, if necessary, thus obtaining a polyester having a hydroxyl group. Next, the polyester having a hydroxyl group is reacted with a polyisocyanate (3) at 40° C. to 140° C., thus obtaining a polyester prepolymer (A) having an isocyanate group. The polyester prepolymer (A) having an isocyanate group is reacted with an amine (B) at 0° C. to 140° C., thus obtaining an urea-modified polyester. In the reaction between the polyester and the polyisocyanate (3), and the reaction between the polyester prepolymer (A) and the amine (B), a solvent may be used, if necessary.

Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), that are inactive against isocyanates.

In a case in which the unmodified polyester (ii) is used in combination with the urea-modified polyester (i), the unmodified polyester (ii) is prepared in the same manner as the polyester having a hydroxyl group is prepared, and dissolved in the solution of the urea-modified polyester (i) after the reaction in the solution has been completed.

The toner according to some embodiments of the present invention may be produced in the following manner.

First, the urea-modified polyester (i) may be produced by reacting the polyester prepolymer (A) having an isocyanate group with the amine (B) in an aqueous medium. Alternatively, the urea-modified polyester (i) that has previously produced may be used. The urea-modified polyester (i) or the prepolymer (A) can be stably dispersed in an aqueous medium as a toner composition, containing the urea-modified polyester (i) and/or the prepolymer (A), is dispersed in the aqueous medium with a shearing force.

The prepolymer (A) and other toner components (i.e., toner raw materials), such as a colorant, a colorant master batch, a release agent, a charge controlling agent, and an unmodified polyester, may be mixed with each other at the time when they are dispersed in an aqueous medium. Alternatively, they may be previously mixed each other, and the mixture may dispersed in an aqueous medium thereafter. The latter is more preferable. In addition, a colorant, a release agent, and a charge controlling agent, are not necessarily mixed with other toner raw materials at the time when particles are formed in an aqueous medium. They may be added to the particles that have already been produced. For example, it is possible to prepare particles including no colorant first and dye the particles with a colorant thereafter.

The aqueous medium may consist of water alone or a combination of water with a water-miscible solvent. Specific examples of the water-miscible solvent include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

Preferably, the amount of the aqueous medium used in combination with 100 parts by mass of the toner composition containing the urea-modified polyester (i) and/or the prepolymer (A) ranges from 50 to 2,000 parts by mass, more preferably from 100 to 1,000 parts by mass. When the used amount of the aqueous medium is 50 parts by mass or more, the toner composition may be dispersed well and toner particles having a desired particle size can be obtained. When the used amount of the aqueous medium is 2,000 parts by mass or less, it is economical in terms of cost.

A dispersant may be used, if necessary, when the toner raw materials are dispersed in the aqueous medium. By using a dispersant, the particle size distribution of the particles becomes narrower and more stable, which is preferable.

Examples of the dispersing method include, but are not limited to, a low-speed shearing method, a high-speed shearing method, a friction method, a high-pressure jet method, and an ultrasonic method. To adjust the particle diameter of the dispersing elements to 2 to 20 μm, a high-speed shearing method is preferable. When a high-speed shearing disperser is used, preferably, the revolution is set to from 1,000 to 30,000 rpm, more preferably from 5,000 to 20,000 rpm. The dispersing time for a batch disperser is typically from 0.1 to 5 minutes, but is not limited thereto. The dispersing temperature is typically from 0° C. to 150° C., more preferably from 40° C. to 98° C. The higher the temperature, the lower the viscosity of the dispersion of the urea-modified polyester (i) and/or the prepolymer (A). Thus, the higher dispersing temperature is preferable in terms of the ease of dispersion.

In the process of obtaining the urea-modified polyester (i) from the prepolymer (A), the amine (B) may be added to the aqueous medium either before or after the toner composition is dispersed in the aqueous medium. In the latter case, the reaction between the amine (B) and the prepolymer (A) starts from the particle interface. Thus, the urea-modified polyester is preferentially generated at the surface of the toner particle, forming a urea concentration gradient within the toner particle.

A dispersant may be used, if necessary, when the amine (B) is added to the aqueous medium.

Specific examples of the dispersant include, but are not limited to, surfactants, poorly-water-soluble inorganic compound dispersants, and polymeric protection colloids. Each of these compounds can be used alone or in combination with others. Among these materials, surfactants are preferable.

Specific examples of the surfactants include, but are not limited to, anionic surfactants, cationic surfactants, nonionic surfactants, and ampholytic surfactants.

Specific examples of the anionic surfactants include, but are not limited to, alkylbenzene sulfonates, α-olefin sulfonates, and phosphates. In particular, these anionic surfactants having a fluoroalkyl groups are preferable. Specific examples of the anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates. Specific examples of commercially available anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of the cationic surfactants include, but are not limited to, amine salt surfactants and quaternary ammonium salt surfactants. Specific examples of the amine salt surfactants include, but are not limited to, alkyl amine salts, amino alcohol fatty acid derivatives, polyamine fatty acid derivatives, and imidazoline. Specific examples of the quaternary ammonium salt surfactants include, but are not limited to, alkyl trimethyl ammonium salts, dialkyl dimethyl ammonium salts, alkyl dimethyl benzyl ammonium salts, pyridinium salts, alkyl isoquinolinium salts, and benzethonium chloride. Specific examples of the cationic surfactants further include, but are not limited to, aliphatic primary, secondary, and tertiary amine acids having a fluoroalkyl group; aliphatic quaternary ammonium salts such as perfluoroalkyl(C6-C10) sulfonamide propyl trimethyl ammonium salts; benzalkonium salts; benzethonium chloride; pyridinium salts; and imidazolinium salts. Specific examples of commercially available cationic surfactants include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific examples of the nonionic surfactants include, but are not limited to, fatty acid amide derivatives and polyol derivatives.

Specific examples of the ampholytic surfactants include, but are not limited to, alanine, dodecyldi(aminoethyl) glycine, di(octylaminoethyl) glycine, N-alkyl-N,N-dimethylammonium betaine.

Specific examples of the poorly-water-soluble inorganic dispersants include, but are not limited to, tricalcium phosphate, calcium carbonate, titanium oxide, colloidal silica, and hydroxyapatite.

Specific examples of the polymeric protection colloids include, but are not limited to, homopolymers and copolymers of acids, acrylic or methacrylic monomers having hydroxyl group, vinyl alcohols and ethers thereof, esters of vinyl alcohols with carboxyl-group-containing compounds, amide compounds and methylol compounds thereof, chlorides, and/or compounds containing nitrogen atom or heterocyclic ring thereof; polyoxyethylenes; and celluloses.

Specific examples of the acids include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific examples of the acrylic or methacrylic monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide, and N-methylol methacrylamide.

Specific examples of the vinyl alcohols and ethers thereof include, but are not limited to, vinyl methyl ether, vinyl ethyl ether, and vinyl propyl ether.

Specific examples of the esters of vinyl alcohols with carboxyl-group-containing compounds include, but are not limited to, vinyl acetate, vinyl propionate, and vinyl butyrate.

Specific examples of the amide compounds and methylol compounds thereof include, but are not limited to, acrylamide, methacrylamide, and diacetone acrylamide, and methylol compounds thereof.

Specific examples of the chlorides include, but are not limited to, acrylic acid chloride and methacrylic acid chloride.

Specific examples of the compounds containing nitrogen atom or heterocyclic ring thereof include, but are not limited to, vinyl pyridine, vinyl pyrrolidone, vinyl imidazole, and ethyleneimine.

Specific examples of the polyoxyethylenes include, but are not limited to, polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester.

Specific examples of the celluloses include, but are not limited to, methyl cellulose, hydroxyethyl cellulose, and hydroxypropyl cellulose.

In preparing the dispersion liquid, a dispersion stabilizer may be used, if necessary. Specific examples of the dispersion stabilizer include, but are not limited to, acid-soluble or alkali-soluble materials such as calcium phosphate.

When calcium phosphate is used as the dispersion stabilizer, calcium phosphate can be removed from the particles by, for example, being dissolved with an acid (e.g., hydrochloric acid) and washed with water, or being decomposed with an enzyme.

In preparing the dispersion liquid, a catalyst for the elongation reaction or the cross-linking reaction may be used. Specific examples of the catalyst include, but are not limited to, dibutyltin laurate and dioctyltin laurate.

Additionally, to lower the viscosity of the toner composition, a solvent that can dissolve the urea-modified polyester (i) and/or the prepolymer (A) may be used. By using such a solvent, the particle size distribution of the particles becomes narrower, which is preferable. Preferably, the solvent is volatile so as to be easily removable.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these solvents can be used alone or in combination with others. Among these solvents, aromatic solvents such as toluene and xylene, and halogenated hydrocarbons such as 1,2-dichloroethane, chloroform, and carbon tetrachloride are preferable. In particular, aromatic solvents such as toluene and xylene are more preferable.

Preferably, the amount of the solvent used in combination with 100 parts by mass of the prepolymer (A) is from 0 to 300 parts by mass, more preferably from 0 to 100 parts by mass, and most preferably from 25 to 70 parts by mass. The solvent can be removed by being heated under normal pressure or reduced pressure after the elongation and/or cross-linking reaction.

The elongation and/or cross-linking reaction time is determined depending on the reactivity between the prepolymer (A) and the amine (B), varying according to the structure of the isocyanate group in the prepolymer (A), and is typically from 10 minutes to 40 hours and preferably from 2 to 24 hours. Preferably, the reaction temperature is in the range of from 0° C. to 150° C., more preferably from 40° C. to 98° C. As necessary, catalysts can be used. Specific examples of usable catalysts include, but are not limited to, dibutyltin laurate and dioctyltin laurate.

The organic solvent can be removed from the resulting emulsion by gradually heating the emulsion to completely evaporate the organic solvent from the liquid droplets in the emulsion. Alternatively, the organic solvent can be removed by spraying the emulsion into dry atmosphere to completely remove non-aqueous organic solvents from the liquid droplet to form toner particles, along with evaporating aqueous dispersants therefrom. Examples of the dry atmosphere into which the emulsion is sprayed include heated gaseous matter such as the air, nitrogen, carbon dioxide gas, or combustion gas. In particular, those heated to above the maximum boiling point among the used solvents are generally used. Such a treatment can be reliably performed by a spray drier, a belt drier, or a rotary kiln, within a short period of time.

In a case in which liquid droplets in the emulsion has a wide particle size distribution and the emulsion has been washed and dried while keeping the wide particle size distribution, the resulting particles are classified by size and particles satisfying a desired particle diameter distribution are collected in what is called a classification treatment.

In the classification treatment, ultrafine particles are removed by means of cyclone separation, decantation, or centrifugal separation in liquid. The classification treatment can be performed after the emulsion has been dried into powder. However, it is more preferable that the classification is performed in a liquid in terms of efficiency. The collected unneeded ultrafine and coarse particles, either in a dry or wet condition, can be reused for preparation of toner particles.

It is preferable that the dispersant is removed from the emulsion as much as possible, more preferably, at the time of the classification treatment.

The dried toner particles may be mixed with heterogeneous particles such as release agent particles, charge controlling agent particles, fluidizer particles, and colorant particles, while applying a mechanical impulsive force to the mixed particles so that the heterogeneous particles are fixed or fused on the surfaces of the toner particles and prevented from releasing therefrom.

For example, (1) an impulsive force may be applied to the mixed particles from blades that is rotating at a high speed. As another example, (2) the mixed particles may be accelerated in a high-speed airflow so that the particles collide with each other or with a collision plate. Such a treatment can be performed by ONG MILL (from Hosokawa Micron Co., Ltd.), a modified I-TYPE MILL such that the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

The toner may include a colorant. Specific examples of the colorant include pigments and dyes conventionally used for toner, such as carbon black, lamp black, iron black, ultramarine, nigrosine dye, aniline blue, phthalocyanine blue, phthalocyanine green, Hansa Yellow G, Rhodamine 6C Lake, Calco Oil Blue, chrome yellow, quinacridone red, benzidine yellow, and rose bengal, but are not limited thereto. Each of these colorants may be used alone or in combination with others.

The toner may further include at least one magnetic component such as iron oxides (e.g., ferrite, magnetite, maghemite), metals (e.g., iron, cobalt, nickel) and alloys thereof, to have magnetic property. Such magnetic components may be also used as colorants.

Preferably, the colorant has a number average particle diameter of 0.5 μm or less, more preferably 0.4 μm or less, and most preferably 0.3 μm or less, when included in the toner. When the number average particle diameter is 0.5 μm or less, dispersibility of the colorant becomes a sufficient level and a desired level of transparency is obtained. Fine colorant particles having a number average particle diameter of less than 0.1 μm are sufficiently smaller than the half wavelength of visible light and therefore do not adversely affect light-reflection and light-absorption properties of the toner. Thus, colorant particles having a number average particle diameter of less than 0.1 μm contribute to excellent color reproducibility and transparency of the toner fixed on an OHP sheet. By contrast, when large colorant particles having a number average particle diameter of 0.5 μm exist in the toner in large amounts, incidence light is prevented from penetrating or caused to scatter. When such a toner is fixed on an OHP sheet, a projected image may be poor in brightness and color saturation. In addition, when large colorant particles having a number average particle diameter of 0.5 μm exist in the toner in large amounts, they are likely to release from the surface of the toner and cause various troubles such as fogging, drum contamination, and defective cleaning. Preferably, large colorant particles having a number average particle diameter of 0.7 μm or more accounts for 10% by number or less, more preferably 5% by number or less, of the all colorant particles.

The colorant may be pre-kneaded with part or all of a binder resin in the presence of a wetting liquid, so that the colorant and the binder resin become sufficiently adhered to each other at an early stage. By this process, the colorant gets dispersed in the toner in an efficient manner in the succeeding process, and the dispersion diameter of the colorant in the toner becomes small. The toner expresses better transparency.

Examples of the binder resin to be kneaded with the colorant in advance include all resins usable as toner binder.

Specifically, the binder resin, the colorant, and the wetting liquid may be premixed by a blender (e.g., HENSCHEL MIXER) and the mixture may be thereafter kneaded by a kneader (e.g., two-roll kneader, three-roll kneader) at a temperature lower than the melting temperature of the binder resin.

The wetting liquid is selected from known liquids considering solubility of the binder resin and wettability to the colorant. Specifically, organic solvents (e.g., acetone, toluene, butanone) and water are preferred as the wetting liquid from the aspect of colorant dispersibility. In particular, water is most preferred for its environment-friendliness and colorant dispersing stability.

As the toner is produced through such a pre-kneading process, the colorant particles are dispersed in the toner more uniformly with a smaller dispersion diameter, providing a projected image with better color reproducibility.

The toner may further include a charge controlling agent to increase the amount of charge or to make the toner more rapidly chargeable. Preferably, the charge controlling agent is colorless or white. A colored material as the charge control agent will change the toner color.

Specific examples of usable charge controlling agents include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901 and LR-147 (boron complex), which are manufactured by Japan Carlit Co., Ltd.; and quinacridone, azo pigments, and polymers having a functional group such as a sulfonate group, a carboxyl group, and a quaternary ammonium group.

The content of the charge controlling agent is determined depending the on the type of binder resin, presence or absence of an additive, and dispersing method, and is not limited to a specific value. Preferably, the content of the charge controlling agent ranges from 0.1 to 10 parts by mass, more preferably from 0.2 to 5 parts by mass, based on 100 parts by mass of the binder resin. When the content of charge controlling agent is 10 parts by mass or less, the toner charge does not become so large. Thus, it is not likely that the effect of the charge controlling agent is reduced while an electrostatic attracting force to a developing roller is increased to cause a decline in developer fluidity and image density. The charge controlling agent may be first mixed with the master batch or the binder resin and thereafter dissolved or dispersed in an organic solvent, or directly added to an organic solvent at the time of dissolving or dispersing. Alternatively, the charge controlling agent may be fixed on the surface of the resulting toner particles.

At the time when a toner composition is dispersed in an aqueous medium in the process of producing a toner, fine resin particles may be added to the aqueous medium for dispersion stability.

The fine resin particles may be made of any resin capable of forming an aqueous dispersion thereof, including thermoplastic resins and thermosetting resins, such as vinyl resin, polyurethane resin, epoxy resin, polyester resin, polyamide resin, polyimide resin, silicon resin, phenol resin, melamine resin, urea resin, aniline resin, ionomer resin, and polycarbonate resin. Each of these resins can be used alone or in combination with others. Among these resins, vinyl resin, polyurethane resin, epoxy resin, polyester resin, and combinations thereof are preferable because they are easy to form aqueous dispersions of fine spherical particles thereof.

Specific examples of the vinyl resin include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The toner may further include an external additive for supplementing fluidity, developability, and chargeability. In particular, fine inorganic particles are preferred as the external additive.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Preferably, the fine inorganic particle has a primary particle diameter of from 5 nm to 2 μm, more preferably from 5 to 500 nm. Preferably, the fine inorganic particle has a BET specific surface area of from 20 to 500 $m^2/g$. Preferably, the content rate of the fine inorganic particle in the toner is from 0.01% to 5% by mass, more preferably from 0.01% to 2.0% by mass.

Additionally, fine particles of polymers are also usable as the external additive, such as polystyrene obtainable by soap-free emulsion polymerization, suspension polymerization, or dispersion polymerization; polycondensation polymers (e.g., copolymers of methacrylates and/or acrylates, silicone polymers, benzoguanamine, nylon); and thermosetting resins.

The toner may further include a fluidizer. The fluidizer may be surface-treated to improve its hydrophobicity to prevent deterioration of fluidity and chargeability even under high-humidity conditions. Specific examples of the fluidizer include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent for removing residual toner particles from a photoconductor or an intermediate transfer medium after image transfer. Specific examples of the cleanability improving agent include, but are not limited to, metal salts of fatty acids (e.g., zinc stearate, calcium stearate) and fine polymer particles prepared by soap-free emulsion polymerization (e.g., polymethyl methacrylate fine particles, polystyrene fine particles). Preferably, such fine polymer particles have a relatively narrow particle size distribution and a volume average particle diameter of from 0.01 to 1 μm.

The toner includes the above-described ester wax as a release agent, as described above. The toner may further include another wax other than the above-described ester wax. However, since the above-described ester wax produces very few dust and UFP and provides excellent releasing ability, sole use of the above-described wax is preferred. When another wax is used in combination with the ester wax, the wax should be checked in advance whether to produce UFP or not upon application of heat.

The main cause of generation of UFP from toner is a wax, as described above. In some cases, UFP is generated from toner constituent materials or impurities. Therefore, it is more preferred that a toner itself (containing no wax) produce very few UFP.

Preferably, the content rate of the ester wax ranges from 2% to 15% by mass based on total mass of the binder resin in the toner. When the content rate is 2% by mass or more, the occurrence of hot offset is prevented. When the content rate is 15% by mass or less, degradation of transferability and durability is prevented.

Preferably, the wax other than the ester wax shows an endothermic peak within a temperature range of from 70° C. to 150° C., when analyzed by a differential scanning calorimeter (DSC). When the melting point is 70° C. or above, deterioration of toner storage stability is prevented. When the melting point is 150° C. or less, releasability is effectively exerted.

Preferably, the content rate of aliphatic alcohols having 18 to 22 carbon atoms in the toner is in the range of from 0.01% to 0.20% by mass, more preferably from 0.01% to 0.15% by mass. When the content rate of aliphatic alcohols having 18 to 22 carbon atoms in the toner is 0.20% by mass or less, the amount of generation of UFP decreases, which is preferable to get the Blue Angel Mark certification.

The above-descried toner is a polymerization toner produced by a polymerization method. Alternatively, the toner according to an embodiment of the present invention may be a pulverization toner produced by a pulverization method.

Specific examples of binder resin for use in pulverization toners include, but are not limited to, homopolymers of styrene and derivatives thereof (e.g., polystyrene, poly-p-chlorostyrene, polyvinyl toluene); styrene copolymers (e.g., styrene-p-chlorostyrene copolymer, styrene-propylene copolymer, styrene-vinyl toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-maleic acid copolymer, styrene-maleate copolymer); homopolymers and copolymers of acrylates (e.g., polymethyl acrylate, polybutyl acrylate, polymethyl methacrylate, polybutyl methacrylate); polyvinyl derivatives (e.g., polyvinyl chloride, polyvinyl acetate); polyester polymers; polyurethane polymers; polyamide polymers; polyimide polymers; polyol polymers; epoxy polymers; terpene polymers; aliphatic or alicyclic hydrocarbon resins; and aromatic petroleum resins. Each of these resins can be used alone or in combination with others. Among these resins, styrene-acrylic copolymers, polyester polymers, and polyol polymers are preferable from the aspect of electric property and cost. In particular, polyester polymers and polyol polymers are more preferable since they provide good fixability.

A pulverization toner may be produced by premixing the binder resin with a colorant, a wax, a charge controlling agent, etc., kneading the mixture at a temperature lower than the melting point of the binder resin, cooling the kneaded mixture, pulverizing the kneaded mixture into particles, and classifying the particles by size, followed by an optional process of mixing with an external additive.

Developer

A developer according to some embodiments of the present invention includes the above-described toner and optional components such as a carrier.

The developer has excellent transferability and chargeability and reliably forms high-quality image. The developer may be either one-component developer or two-component developer. Two-component developers are more suitable to be used in a high-speed printer, that can respond to recent improvement in information processing speed, because the lifespan thereof is much longer.

Carrier

Examples of the carrier include a magnetic carrier and a resin carrier. The magnetic carrier may be comprised of iron powder, ferrite powder, magnetite powder, or magnetic resin particles, having a particle diameter about 20 to 200 μm. In a two-component developer, preferably, the mass ratio of the toner to the carrier is in the range of from 1/100 to 10/100.

Preferably, the carrier includes a core material and a resin layer coating the core material.

Toner Storing Unit

A toner storing unit according to an embodiment of the present invention includes a unit having a function of storing toner; and the above-described toner stored in the unit. The toner storing unit may be in the form of a toner container, a developing device, or a process cartridge.

The toner container is a container containing the toner or the developer consisting of the toner and a carrier.

The developing device includes means for storing and developing the toner.

The process cartridge includes at least an electrostatic latent image bearer (or simply image bearer) integrated with a developing unit, and stores the toner. The process cartridge is detachably mountable on an image forming apparatus. The process cartridge may further include at least one of a charger, an irradiator, and a cleaner.

An image forming apparatus mounting the above toner storing unit storing the toner according to an embodiment of the present invention can reduce the amount of UFP generated from the image forming apparatus.

Image Forming Apparatus and Image Forming Method

An image forming apparatus according to some embodiments of the present invention includes an electrostatic latent image bearer, an electrostatic latent image forming device to form an electrostatic latent image on the electrostatic latent image bearer, a developing device containing the above developer configured to develop the electrostatic latent image formed on the electrostatic latent image bearer into a toner image with the developer. The image forming apparatus may optionally include other devices, if needed.

An image forming method according to some embodiments of the present invention includes at least an electrostatic latent image forming process and a developing process, and optionally other processes, if necessary.

The image forming method is preferably performed by the image forming apparatus. The electrostatic latent image forming process is preferably performed by the electrostatic latent image forming device. The developing process is preferably performed by the developing device. The other processes are preferably performed by the other devices.

Preferably, the image forming apparatus includes an electrostatic latent image bearer, an electrostatic latent image forming device to form an electrostatic latent image on the electrostatic latent image bearer, a developing device containing a toner configured to develop the electrostatic latent image formed on the electrostatic latent image bearer into a toner image with the toner, a transfer device to transfer the toner image formed on the electrostatic latent image bearer onto a surface of a recording medium, and a fixing device to fix the toner image on the surface of the recording medium.

Preferably, the image forming method includes an electrostatic latent image forming process to form an electrostatic latent image on an electrostatic latent image bearer, a developing process to develop the electrostatic latent image formed on the electrostatic latent image bearer into a toner image with the toner, a transfer process to transfer the toner image formed on the electrostatic latent image bearer onto a surface of a recording medium, and a fixing process to fix the toner image on the surface of the recording medium.

In the developing device and the developing process, the above-described toner is used. Preferably, the toner image is formed with a developer including the toner and other components such as a carrier.

Electrostatic Latent Image Bearer

The electrostatic latent image bearer is not limited in material, structure, and size. Specific usable materials include, but are not limited to, inorganic photoconductors such as amorphous silicon and selenium, and organic photoconductors such as polysilane and phthalopolymethyne.

Electrostatic Latent Image Forming Device

The electrostatic latent image forming device is not limited in configuration so long as it forms an electrostatic latent image on the electrostatic latent image bearer. The electrostatic latent image forming device may include at least a charger to charge a surface of the electrostatic latent image bearer and an irradiator to irradiate the surface of the electrostatic latent image bearer with light containing image information.

Developing Device

The developing device is not limited in configuration so long as it develops the electrostatic latent image formed on the electrostatic latent image bearer into a visible image with toner.

Other Devices

The other devices may include, for example, a transfer device, a fixing device, a cleaner, a neutralizer, a recycler, and a controller.

Tandem-type Full-color Image Forming Apparatus

The image forming apparatus according to some embodiments of the present invention may be of a tandem-type full-color image forming apparatus.

As an example of such an image forming apparatus, an electrophotographic printer 500 (hereinafter simply "printer 500") is described in detail below.

FIG. 1 is a schematic view of the printer 500. The printer 500 includes four image forming units 1Y, 1C, 1M, and 1K for forming yellow, cyan, magenta, and black images, respectively. The image forming units 1Y, 1C, 1M, and 1K have the same configuration except for storing different-color toners, i.e., yellow, cyan, magenta, and black toners, respectively.

Above the four image forming units 1Y, 1C, 1M, and 1K (hereinafter collectively "image forming units 1"), a transfer unit 60 is disposed. The transfer unit 60 includes an intermediate transfer belt 114 serving as an intermediate transferor. The image forming units 1Y, 1C, 1M, and 1K include respective photoconductors 3Y, 3C, 3M, and 3K on which toner images with respective color are to be formed. The toner images are superimposed on one another on a surface of the intermediate transfer belt 114.

Below the four image forming units 1, an optical writing unit 40 is disposed. The optical writing unit 40, serving as a latent image forming device, emits laser light L based on image information to the photoconductors 3Y, 3C, 3M, and 3K in the respective image forming units 1Y, 1C, 1M, and 1K. Thus, electrostatic latent images for yellow, cyan, magenta, and black images are formed on the respective photoconductors 3Y, 3C, 3M, and 3K. In the optical writing unit 40, the laser light L is emitted from a light source, deflected by a polygon mirror 41 that is rotary-driven by a motor, and directed to the photoconductors 3Y, 3C, 3M, and 3K through multiple optical lenses and mirrors. Alternatively, the optical writing unit 40 may employ an optical scanning method using an LED array.

Below the optical writing unit 40, a first sheet tray 151 and a second sheet tray 152 are disposed overlapping with each other in the vertical direction. In each sheet tray, multiple sheets of transfer paper P, serving as recording media, are stacked on top of another. The top sheet P is in contact with a first sheet feeding roller 151*a* and a second sheet feeding roller 152*a*. As the first sheet feeding roller 151*a* is rotary-driven counterclockwise in FIG. 1 by a driver, the top sheet P in the first sheet tray 151 is fed to a sheet feeding path 153 vertically extended on a right side of the first sheet tray 151 in FIG. 1. As the second sheet feeding roller 152*a* is rotary-driven counterclockwise in FIG. 1 by a driver, the top sheet P in the second sheet tray 152 is fed to the sheet feeding path 153.

On the sheet feeding path 153, multiple conveyance roller pairs 154 are disposed. The sheet P is fed upward in FIG. 1 within the sheet feeding path 153 while being nipped by the conveyance roller pairs 154.

On a downstream end of the sheet feeding path 153 relative to the direction of conveyance of the sheet P, a registration roller pair 55 is disposed. The registration rollers of the registration roller pair 55 nip the sheet P fed by the conveyance roller pairs 154 and stop rotating immediately thereafter. The registration rollers then feed the sheet P to a secondary transfer nip at a proper timing.

Figure 2:
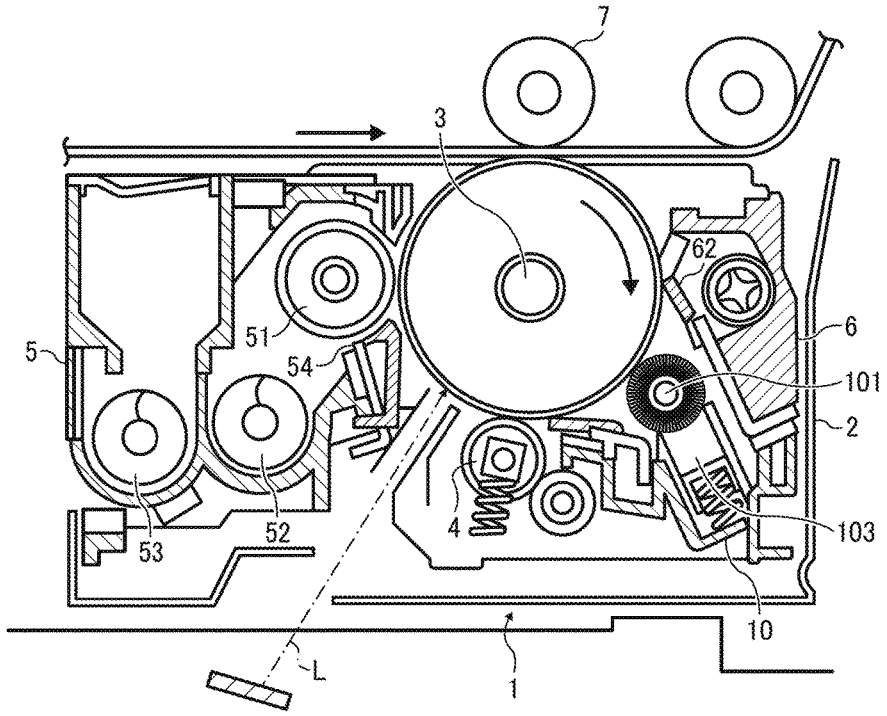
FIG. 2 is a schematic view of an image forming apparatus according to an embodiment of the present invention.

FIG. 2 is a schematic view of one of the four image forming units 1. The image forming unit 1 includes a drum-like photoconductor 3 serving as an image bearer. According to another embodiment, the photoconductor 3 may be in the form of a sheet or an endless belt.

Around the photoconductor 3, a charger 4, a developing device 5, a transfer device 7, a cleaner 6, a lubricant applicator 10, and a neutralization lamp are disposed.

The charger 4 is disposed away from the photoconductor 3 with a certain distance therebetween. The charger 4 charges the photoconductor 3 to a predetermined polarity and potential. After the charger 4 has uniformly charged the photoconductor 3, an irradiator (serving as a latent image forming device) emits laser light L to the photoconductor 3 based on image information to form an electrostatic latent image thereon.

The developing device 5 includes a developing roller 51 serving as a developer bearer. The developing roller 51 is applied with a developing bias from a power source. Within the casing of the developing device 5, a supply screw 52 and a stirring screw 53 are disposed. The supply screw 52 and the stirring screw 53 rotate in opposite directions, thereby stirring and conveying a developer stored in the casing. Also, a doctor blade 54 that regulates the developer carried on the developing roller 51 is disposed within the casing. The developer is charged to a predetermined polarity as being stirred and conveyed by the supply screw 52 and the stirring screw 53. The developer is then carried on the developing roller 51, regulated by the doctor blade 54, and adhered to a latent image formed on the photoconductor 3 at a developing region where the developing roller 51 faces the photoconductor 3.

The cleaner 6 includes a fur brush 101 and a cleaning blade 62. The cleaning blade 62 is in contact with the photoconductor 3 so as to face in the direction of movement of the surface of the photoconductor 3.

The lubricant applicator 10 includes a solid lubricant 103 and a lubricant pressing spring. The fur brush 101 serves as an application brush that applies the solid lubricant 103 to the photoconductor 3. The solid lubricant 103 is held by a bracket and pressed toward the fur brush 101 by the lubricant pressing spring. As the fur brush 101 rotates so as to trail the rotation of the photoconductor 3, the solid lubricant 103 is scraped by the fur brush 101 and the scraped-off lubricant is applied to the photoconductor 3. The surface of the photoconductor 3 maintains a frictional coefficient of 0.2 or less during non-image forming periods due to application of the lubricant.

Specific examples of the charger 4 include a corotron, a scorotron, and a solid state charger, but are not limited thereto.

In particular, contact chargers and non-contact closely-arranged chargers are preferred, since they have advantages of high charging efficiency, less generation of ozone, and compact size.

The irradiator and the neutralization lamp may include a light source selected from all luminous matters, such as a fluorescent lamp, a tungsten lamp, a halogen lamp, a mercury lamp, a sodium-vapor lamp, a light-emitting diode (LED), a laser diode (LD), and an electroluminescence (EL).

For the purpose of emitting light having a desired wavelength only, any type of filter can be used such as a sharp cut filter, a band pass filter, a near infrared cut filter, a dichroic filter, an interference filter, and a color-temperature conversion filter.

Among the above light sources, light-emitting diode and light-emitting diode are preferred since they can emit long-wavelength light (600-800 nm) with high energy.

An image forming operation of the printer 500 is described below.

In response to receipt of a print execution signal from an operation panel, the charger 4 and the developing roller 51 are each applied with a predetermined voltage or current at a predetermined timing. At the same time, the irradiator and the neutralization lamp are each applied with a predetermined voltage or current at a predetermined timing. In synchronization of the application of voltage or current, the photoconductor 3 is driven to rotate in a direction indicated by arrow in FIG. 2 by a photoconductor driving motor.

As the photoconductor 3 starts rotating in a direction indicated by arrow in FIG. 2, the surface of the photoconductor 3 is charged to a predetermined potential by the charger 4. The irradiator then emits light L, corresponding to an image signal, to the photoconductor 3. A part of the photoconductor 3 irradiated with the light L is neutralized, thus forming an electrostatic latent image.

The surface of the photoconductor 3 having the electrostatic latent image thereon is rubbed with a magnetic brush of the developer formed on the developing roller 51, at a region where the photoconductor 3 faces the developing device 5. As a developing bias is applied to the developing roller 51, negatively-charged toner particles on the developing roller 51 are transferred onto the electrostatic latent image, thus forming a toner image. In the present embodiment, the developing device 5 develops the electrostatic latent image formed on the photoconductor 3 into a toner image with the negatively-charged toner particles by means of reverse development. In the present embodiment, an N/P development (in which toner particles are adhered to low-potential regions) and a non-contact charging roller are employed, but the development and charging types are not limited thereto.

The toner image formed on the photoconductor 3 is transferred onto a sheet in a transfer region that is formed between the photoconductor 3 and the transfer device 7. The sheet has been fed to the transfer region from a sheet feeding unit via a position where an upper registration roller and a lower registration roller are facing each other. Specifically, the sheet is fed from the position where the upper registration roller and the lower registration roller are facing each other to the transfer region in synchronization with an entry of a tip of an image to the transfer region. When the toner image is transferred onto the sheet, a transfer bias applied. The sheet having the toner image thereon is separated from the photoconductor 3 and conveyed to a fixing device. In the fixing device, the toner image is fixed on the sheet by the action of heat and pressure. The sheet having the fixed toner image thereon is ejected from the printer.

After the toner image has been transferred, residual toner particles remaining on the surface of the photoconductor 3 are removed by the cleaner 6. The surface of the photoconductor 3 is applied with a lubricant by the lubricant applicator 10 and thereafter neutralized by the neutralization lamp.

In the present embodiment, the photoconductor 3, the charger 4, the developing device 5, the cleaner 6, and the lubricant applicator 10 are stored in a casing 2, thus forming a process cartridge. The process cartridge is detachably mountable on the apparatus body. In the present embodiment, the photoconductor 3 and the other devices are integrally replaceable as a process cartridge. According to another embodiment, each of the photoconductor 3, the charger 4, the developing device 5, the cleaner 6, and the lubricant applicator 10 is independently replaceable.

Figure 3:
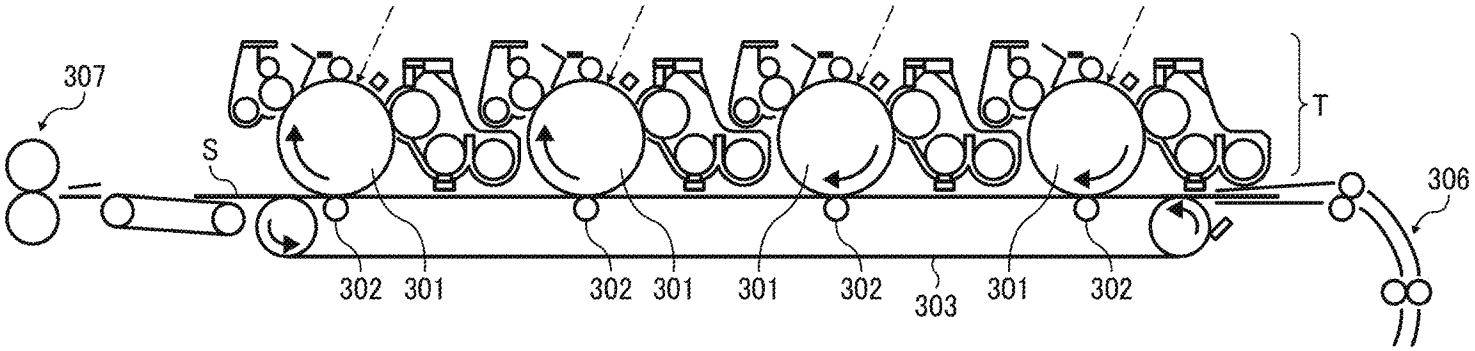
FIG. 3 is a schematic view of an image forming apparatus according to an embodiment of the present invention.
Figure 4:
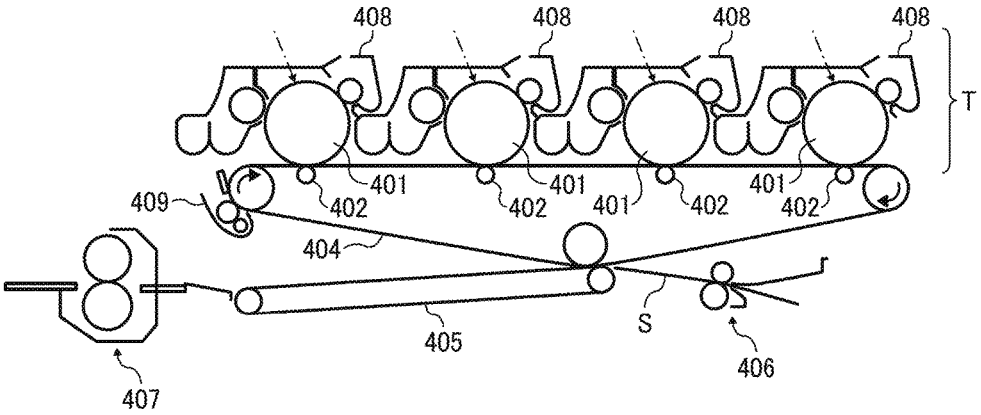
FIG. 4 is a schematic view of an image forming apparatus according to an embodiment of the present invention.

FIG. 3 is a schematic view of a tandem-type electrophotographic apparatus employing a direct transfer method. In the apparatus illustrated in FIG. 3, an image formed on each photoconductor 301 is sequentially transferred onto a sheet S conveyed by a sheet conveyance belt 303 by each transfer device 302. FIG. 4 is a schematic view of a tandem-type electrophotographic apparatus employing an indirect transfer method. In the apparatus illustrated in FIG. 4, an image formed on each photoconductor 401 is sequentially transferred onto an intermediate transfer member 404 by each primary transfer device 402, and the images transferred onto the intermediate transfer member 404 are transferred onto a sheet S at once by a secondary transfer device 405. The secondary transfer device 405 illustrated in FIG. 4 is in the form of a transfer conveyance belt. According to another embodiment, the secondary transfer device 405 may be in the form of a roller.

In comparing the above apparatuses respectively employing the direct and indirect transfer methods, the former is more disadvantageous in terms of size, because a paper feeder 306 and a fixing device 307 should be respectively arranged upstream and downstream of a tandem-type image forming unit T in which the photoconductors 301 are arranged in tandem. This makes the apparatus larger in the direction of conveyance of sheet. By contrast, in the latter, the secondary transfer position can be set relatively freely. Therefore, a paper feeder 406 and a fixing device 407 can be arranged overlapping the tandem-type image forming unit T, advantageously making the apparatus more compact.

In the former, the fixing device 307 should be arranged close to the tandem-type image forming unit T, so as not to make the apparatus larger in the direction of conveyance of sheet. This does not permit the fixing device 307 be arranged with a wide marginal space wherein the sheet S can sag. Thus, the fixing device 307 will make negative impacts on the upstream image forming processes due to an impact of the leading edge of the sheet S entering into the fixing device 307 (notable when the sheet is thick) and the difference in sheet conveyance speed between the fixing device 307 and the transfer conveyance belt.

In the latter, on the other hand, the fixing device 407 can be arranged with a wide marginal space wherein the sheet S can sag. Thus, the fixing device 407 will not make negative impacts on the upstream image forming processes.

In view of this situation, tandem-type electrophotographic apparatuses employing an indirect transfer method have been receiving attention recently.

In such an electrophotographic apparatus illustrated in FIG. 4, residual toner particles remaining on the photoconductor 401 after the primary transfer are removed by a photoconductor cleaner 408 to clean the surface of the photoconductor 401. Thus, the photoconductor 401 gets ready for a next image forming operation. Residual toner particles remaining on the intermediate transfer member 404 after the secondary transfer are removed by an intermediate transfer member cleaner 409 to clean the surface of the intermediate transfer member 404. Thus, the intermediate transfer member 404 gets ready for a next image forming operation.

Figure 5:
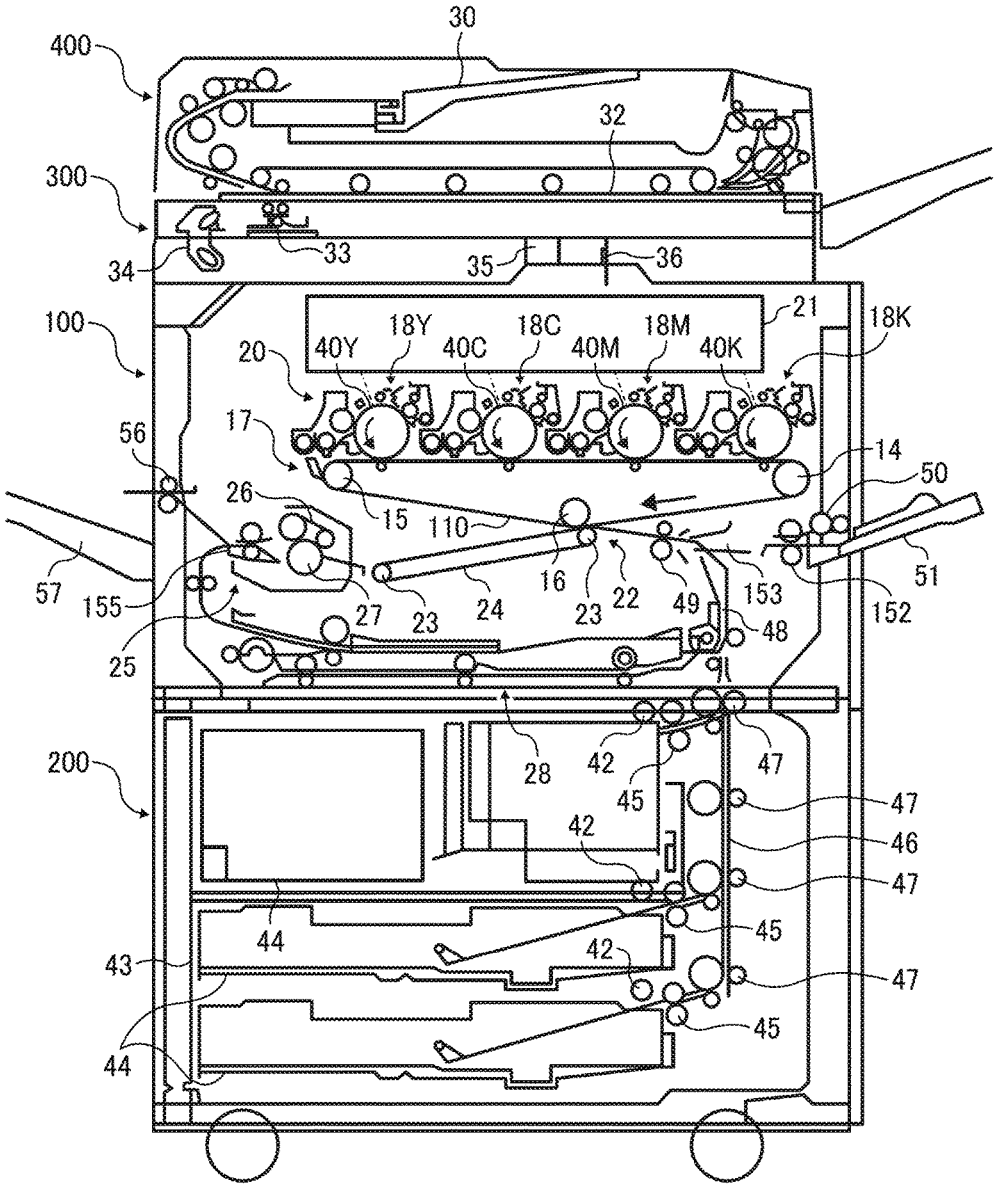
FIG. 5 is a schematic view of an image forming apparatus according to an embodiment of the present invention.

FIG. 5 is a schematic view of another tandem-type electrophotographic apparatus employing an indirect transfer method according to an embodiment of the present invention. The image forming apparatus includes a main body 100, a sheet feed table 200 on which the main body 100 is put, a scanner 300 attached onto the main body 100, and an automatic document feeder (ADF) 400 attached onto the scanner 300. The main body 100 includes an intermediate transfer member 110 in the form of a seamless belt is disposed at the center thereof.

The intermediate transfer member 110 is stretched across three support rollers 14, 15, and 16 and rotatable clockwise in FIG. 5.

An intermediate transfer member cleaner 17 is disposed on the left side of the second support roller 15 in FIG. 5 to remove residual toner particles remaining on the intermediate transfer member 110 after image transfer.

Image forming units 18Y, 18C, 18M, and 18K for forming respective images of yellow, cyan, magenta, and black are arranged in tandem along a surface of the intermediate transfer member 110 stretched between the first and second support rollers 14 and 15, thus forming a tandem image forming unit 20.

An irradiator 21 is disposed immediately above the tandem image forming unit 20 as illustrated in FIG. 5. A secondary transfer device 22 is disposed on the opposite side of the tandem image forming unit 20 relative to the intermediate transfer member 110. The secondary transfer device 22 includes a secondary transfer belt 24 in the form of a seamless belt stretched between two rollers 23. The secondary transfer belt 24 is pressed against the third support roller 16 with the intermediate transfer member 110 therebetween. The secondary transfer device 22 is configured to transfer an image from the intermediate transfer member 110 onto a sheet.

A fixing device 25 to fix a toner image on the sheet is disposed near the secondary transfer device 22. The fixing device 25 includes a fixing belt 26 in the form of a seamless belt and a pressing roller 27 pressed against the fixing belt 26.

The secondary transfer device 22 has another function of conveying sheets having toner image thereon to the fixing device 25. A transfer roller or a non-contact charger may be used as the secondary transfer device 22. In this case, the secondary transfer device 22 need not necessarily have the function of conveying sheets.

A sheet reversing device 28 is disposed below the secondary transfer device 22 and the fixing device 25 and in parallel with the tandem image forming unit 20. The sheet reversing device 28 is configured to reverse a sheet upside down so that images can be recorded on both sides of the sheet.

To make a copy, a document is set on a document table 30 of the automatic document feeder 400. Alternatively, a document is set on a contact glass 32 of the scanner 300 while the automatic document feeder 400 is lifted up. The automatic document feeder 400 is held down after the document has been set on the contact glass 32.

As a switch is pressed, in a case in which a document is set on the contact glass 32, the scanner 300 immediately starts driving to run a first runner 33 and a second runner 34. In a case in which a document is set on the automatic document feeder 400, the scanner 300 starts driving after the document is fed onto the contact glass 32. The first runner 33 directs light from a light source to the document and reflects a light reflected from the document toward the second runner 34. A mirror in the second runner 34 reflects the light toward a reading sensor 36 through an imaging lens 35. Thus, the document is read.

On the other hand, as the switch is pressed, one of the support rollers 14, 15, and 16 is driven to rotate by a driving motor and the other two support rollers are driven to rotate by rotation of the rotating support roller. Thus, the intermediate transfer member 110 is rotatably conveyed. At the same time, in the image forming units 18Y, 18C, 18M, and 18K, single-color toner images of yellow, magenta, cyan, and black are formed on photoconductors 40Y, 40C, 40M, and 40K, respectively. The single-color toner images are sequentially transferred onto the intermediate transfer member 110 as the intermediate transfer member 110 is conveyed. As a result, a composite full-color toner image is formed thereon.

On the other hand, as the switch is pressed, one of sheet feed rollers 42 starts rotating in the sheet feed table 200 to feed sheets of recording paper from one of sheet feed cassettes 44 in a sheet bank 43. One of separation rollers 45 separates the sheets one by one and feeds them to a sheet feed path 46. Feed rollers 47 feed each sheet to a sheet feed path 48 in the main body 100. The sheet is stopped by striking a registration roller 49.

Alternatively, a feed roller 51 starts rotating to feed sheets from a manual feed tray 50. A separation roller 152 separates the sheets one by one and feeds them to a manual sheet feed path 153. The sheet is stopped by striking the registration roller 49.

The registration roller 49 starts rotating to feed the sheet to between the intermediate transfer member 110 and the secondary transfer device 22 in synchronization with an entry of the composite full-color toner image formed on the intermediate transfer member 110 thereto. The secondary transfer device 22 then transfers the composite full-color toner image onto the sheet.

The secondary transfer device 22 then feeds the sheet to the fixing device 25. In the fixing device 25, the transferred toner image is fixed on the sheet by application of heat and pressure. A switch claw 155 switches sheet feed paths so that the sheet is discharged by a discharge roller 56 onto a discharge tray 57. Alternatively, the switch claw 155 may switch sheet feed paths so that the sheet is introduced into the sheet reversing device 28. In the sheet reversing device 28, the sheet gets reversed and is introduced to the transfer position again to record another image on the back side of the sheet. Thereafter, the sheet is discharged by the discharge roller 56 onto the discharge tray 57.

On the other hand, the intermediate transfer member cleaner 17 removes residual toner particles remaining on the intermediate transfer member 110 after image transfer. Thus, the tandem image forming unit 20 gets ready for a next image formation.

The registration roller 49 is generally grounded. Alternatively, it is possible that the registration roller 49 is applied with a bias for the purpose of removing paper powders from the sheet.

EXAMPLES

Having generally described this invention, further understanding can be obtained by reference to certain specific examples which are provided herein for the purpose of illustration only and are not intended to be limiting. In the descriptions in the following examples, the numbers in "parts" or "%" represent mass ratio in parts or %, unless otherwise specified.

Preparation of Ester Waxes

Comparative Example I-1

A commercially-available ester wax 1 (having a mass average molecular weight of 620 and an endothermic peak at 70.8° C. with a half-value with of 5.3° C.) that contains octadecyl docosanoate, icosyl docosanoate, docosyl docosanoate, and octadecyl icosanoate as the long-chain aliphatic esters represented by the formula (A) was subjected to a gas chromatography mass spectroscopy (GC-MS) analysis to quantify aliphatic alcohols having 18 to 22 carbon atoms included therein. As a result, the content rate of aliphatic alcohols having 18 to 22 carbon atoms was 3.5%.

In the GC-MS analysis, aliphatic alcohols having 18 to 22 carbon atoms were quantified using a GC-MS device equipped with a thermal desorption (TD) device under the following conditions.

Device Configuration
TD: UNITY2 (product of Markes International)
GC-MS: SCION TQ (product of Bruker)
Measurement Conditions
(for TD)
Tube heating: 300° C. (3 min), Desorption flow rate: 10 ml/min
Cold trap: General purpose (Graphitised carbon)
Cold trap temperature: from −10° C. to 320° C. (3 min)
(for GC)
Columns: ZB-5 ms 30 m, 0.25 mm, 0.25 μm
Column pressure: 15.6 psi (Constant pressure)
Oven: 40° C. (5 min)−20° C./min−320° C. (5 min)
Interface temperature: 280° C.
(for MS)
Ionization mode: EI, Electron energy: 70 eV
Ion source temperature: 220° C.
Measurement mode: Scan (m/z 33-600)

An aluminum petri dish having an inner diameter of 22 mm was charged with 3 mg of the ester wax 1. The petri dish was put on a hot plate within a tester (having a chamber having a volume of 1 $m^3$, in which ventilation is performed 5 times) located in a testing laboratory of the Blue Angel Mark. After heating the petri dish at 220° C. for 10 minutes, the concentration of UFP was measured using an instrument Fast Mobility Particle Sizer (FMPS) Model 3091 (product of TSI). As a result, the concentration of UFP generated from the ester wax 1 was $1.4\times10^5$ particles/$cm^3$.

Example I-1

The ester wax 1, the same wax as used in Comparative Example I-1, was dissolved in n-hexane by application of heat. After separating n-hexane-insoluble matters, the n-hexane solution was heated to 210° C. for 30 minutes to vaporize n-hexane, followed by cooling to normal temperature. Thus, an ester wax 2 was obtained. The ester wax 2 was vacuum-dried in a vacuum drier, without using a trap, at 200° for 1 hour to be refined.

Aliphatic alcohols having 18 to 22 carbon atoms in the ester wax 2 were quantified by the GC-MS analysis. As a result, the content rate of aliphatic alcohols having 18 to 22 carbon atoms was 1.2%.

An aluminum petri dish having an inner diameter of 22 mm was charged with 3 mg of the ester wax 2. The petri dish was put on a hot plate within a tester (having a chamber having a volume of 1 $m^3$, in which ventilation is performed 5 times) located in a testing laboratory of the Blue Angel Mark. After heating the petri dish at 220° C. for 10 minutes, the concentration of UFP was measured using an instrument Fast Mobility Particle Sizer (FMPS) Model 3091 (product of TSI). As a result, the concentration of UFP generated from the ester wax 2 was $4.0\times10^4$ particles/$cm^3$.

Examples I-2 to I-5

The procedure in Example I-1 was repeated in each of Examples I-2 to I-5 while changing the temperature and time for vacuum drying. As a result, ester waxes 3 to 6 having a content rate of aliphatic alcohols having 18 to 22 carbon atoms of 1.1%, 0.60%, 0.12%, and 0.09%, respectively, were obtained. In the vacuum drying refining, a trap having been cooled with liquid nitrogen was used.

An aluminum petri dish having an inner diameter of 22 mm was charged with 3 mg of each of the ester waxes 3 to 6. The petri dish was put on a hot plate within a tester (having a chamber having a volume of 1 $m^3$, in which ventilation is performed 5 times) located in a testing laboratory of the Blue Angel Mark. After heating the petri dish at 220° C. for 10 minutes, the concentration of UFP was measured using an instrument Fast Mobility Particle Sizer (FMPS) Model 3091 (product of TSI). As a result, the concentration of UFP generated from the ester waxes 3 to 6 were $1.4\times10^5$ particles/$cm^3$, $7.1\times10^4$ particles/$cm^3$, $8.8\times10^3$ particles/$cm^3$, and $2.0\times10^1$ particles/$cm^3$ (noise level), respectively.

Since the amount of generation of UFP is small in Examples I-2 to I-5, the amount of test sample was increased to 10 mg in the test.

Example I-6

The ester wax 1 was subjected to a vacuum refining, without using a trap, at 195° C. for 45 minutes. Thus, an ester wax 7 was obtained. The content rate of aliphatic alcohols having 18 to 22 carbon atoms in the refined ester wax 7 was 2.9% by mass.

The UFP concentration was $9.1\times10^4$ particles/$cm^3$, when measured in the same manner as that for the ester wax 2 in Example I-1.

Example I-7

Behenic acid, docosanol, and stearyl alcohol, in a molar ratio of 2.1/1/1, were subjected to a reaction, and subsequently a washing and a drying. Thus, an ester wax 8 (i.e., a mixture of docosyl docosanoate and octadecyl docosanoate) was prepared.

The ester wax 8 was subjected to the measurement of content rate of aliphatic alcohols having 18 to 22 carbon atoms. As a result, no aliphatic alcohol having 18 to 22 carbon atoms was detected.

The UFP concentration was $1.8\times10^{1}$ particles/cm$^3$, when measured in the same manner as that for the ester wax 2 in Example I-2.

The analysis results for Comparative Example I-1 and Examples I-1 to I-7 are shown in Table 1.

TABLE 1

| | Raw Material Ester Wax | Ester Wax No. | Content Rate of C18-C22 Aliphatic Alcohols (% by mass) | UFP Concentration Measurement: Test Sample Amount (mg) | UFP Concentration Measurement: UFP Conc. (particles/cm$^3$) | Endothermic Peak by DSC (° C.) | Half Bandwidth of Endothermic Peak (° C.) |
|---|---|---|---|---|---|---|---|
| Comparative Example I-1 | Commercially-available Ester Wax | 1 | 3.5 | 3 | $1.4 \times 10^5$ | 70.8 | 5.3 |
| Example I-1 | | 2 | 1.2 | 3 | $4.0 \times 10^4$ | 70.8 | 5.3 |
| Example I-2 | | 3 | 1.1 | 10 | $1.4 \times 10^5$ | 70.8 | 5.3 |
| Example I-3 | | 4 | 0.60 | 10 | $7.1 \times 10^4$ | 70.8 | 5.3 |
| Example I-4 | | 5 | 0.12 | 10 | $8.8 \times 10^3$ | 70.8 | 5.3 |
| Example I-5 | | 6 | 0.09 | 10 | $2.0 \times 10^1$ | 70.8 | 5.3 |
| Example I-6 | | 7 | 2.9 | 3 | $9.1 \times 10^4$ | 70.9 | 5.2 |
| Example I-7 | Synthetic Ester Wax | 8 | Undetected | 10 | $1.8 \times 10^1$ | 69.8 | 5.1 |

Preparation of Two-Component Developers

Comparative Example II-1 and Examples II-1 to II-3

Formulation of Mother Toner Particle

Polyester resin (having a weight average molecular weight of 68,200 and a glass transition temperature (Tg) of 65.6° C.): 100 parts Colorant (Carbon black): 10 parts Release agent (Ester wax): 9 parts Charge controlling agent (Monoazo Fe metal complex): 2 parts Mother toner particles were prepared according to the above-described formulation, while employing the ester wax 1, the ester wax 4, the ester wax 5, and the ester wax 6, respectively, as the release agent.

The constitutional materials were premixed by a HENSCHEL MIXER FM20B (product of Mitsui Miike Chemical Engineering Machinery). The resulting mixture was melt-kneaded by a two-axis extruder PCM-30 (product of Ikegai Corp) while setting the temperatures of the kneader and the feeder to 121° C. and 98° C., respectively. The kneaded product was extended into a plate having a thickness of 2.7 mm by a roller. The plate was cooled to room temperature by a belt cooler and thereafter pulverized into coarse particles having a size of from 200 to 300 μm by a hammer mill. The coarse particles were further pulverized into fine particles by an ultrasonic jet pulverizer LABOJET (product of Nippon Pneumatic Mfg. Co., Ltd.). The fine particles were classified by size using an airflow classifier MDS-1 (product of Nippon Pneumatic Mfg. Co., Ltd.) while controlling the louver opening so that the collected particles had a weight average particle diameter of 8.0±0.2 μm. Thus, mother toner particles 1 to 4, respectively according to Comparative Example II-1 and Examples II-1 to II-3, were obtained. Each of the mother toner particles 1 to 4 had an average circularity of 0.930.

Each of the mother toner particles 1 to 4 in an amount of 150 g was mixed with 1.5 g of a silica particle and 1.1 g of a titanium oxide particle using a 2-L HENSCHEL MIXER at a peripheral speed of 40 m/sec for 5 minutes, so that the silica particle and the titanium oxide particle were externally added to the surface of the mother toner particles. Thus, toners 1 to 4 were prepared.

Aliphatic alcohols having 18 to 22 carbon atoms in each of the toners 1 to 4 were quantified by the GC-MS analysis. As a result, the content rates of aliphatic alcohols having 18 to 22 carbon atoms in the toners 1 to 4 were 0.27% by mass, 0.050% by mass, 0.010% by mass, and 0.007% by mass, respectively.

Next, two-component developers were prepared using the toners 1 to 4 in the following manner.

Preparation of Carrier

Core Material

Mn ferrite particle (having a weight average particle diameter of 35 μm): 5,000 parts Coating materials Toluene: 450 parts Silicone resin (SR2400 from Dow Corning Toray Co., Ltd., including 50% of non-volatile contents): 450 parts Aminosilane (SH6020 from Dow Corning Toray Co., Ltd.): 10 parts Carbon black: 10 parts The above coating materials were subjected to a dispersion treatment using a stirrer for 10 minutes to prepare a coating liquid. The coating liquid and the core material were put into a coating device equipped with a fluidized bed having a rotary bottom disc and agitation blades, configured to generate a swirling flow, so that the coating liquid was applied to the core material. The core material to which the coating liquid had been applied was burnt in an electric furnace at 250° C. for 2 hours. Thus, a carrier was prepared.

Preparation of Two-Component Developers

Each of the toners 1 to 4 in an amount of 7 parts and the above-prepared carrier, having a weight average particle diameter of 35 μm and a silicone coating layer having an average thickness of 0.5 pin, in an amount of 100 parts were contained in a container. The container was subjected to an agitation by a TURBULA MIXER that causes the container to undergo rolling motion, so that the toner and the carrier in the container were stirred, uniformly mixed, and charged. Thus, two-component developers 1 to 4 were prepared.

Each of the developers 1 to 4, along with the respective toners 1 to 4, was mounted on a printer MP401SPF (product of Ricoh Co., Ltd.) which had been modified such that the fixing temperature was 6° C. higher than the initial setting. The printer was put in a tester (having a chamber having a volume of 5 $m^3$) located in a testing laboratory of the Blue Angel Mark and subjected to a measurement of the rate of generation of UFP. As a result, the rates of generation of UFP for the developers 1 to 4 were $5.5\times10^{11}$ particles/10 min, $3.1\times10^{11}$ particles/10 min, $1.9\times10^{11}$ particles/10 min, and $2.3\times10^{11}$ particles/10 min, respectively.

The rate of generation of UFP was measured using a Fast Mobility Particle Sizer (FMPS) Model 3091 (product of TSI) based on a method according to RAL-UZ 171.

Example II-4

Synthesis of Polyester 1

In a reaction vessel equipped with a condenser, a stirrer, and a nitrogen inlet pipe, 230 parts of ethylene oxide 2 mol adduct of bisphenol A, 525 parts of propylene oxide 3 mol adduct of bisphenol A, 203 parts of terephthalic acid, 46 parts of adipic acid, and 2 parts of dibutyltin oxide were subjected to a reaction at 230° C. for 7 hours under normal pressures and subsequent 8 hours under reduced pressured of 10 to 15 mmHg. After 47 parts of trimellitic anhydride was further added to the reaction vessel, the vessel contents were subjected to a reaction at 170° C. for 2 hours under normal pressures. Thus, a polyester 1 was prepared.

The polyester 1 had a number average molecular weight of 2,650, a mass average molecular weight of 6,800, a glass transition temperature of 44.2° C. (measured by a differential scanning calorimeter DSC6200 available from Seiko Instruments Inc.), and an acid value of 26.2 mgKOH/g.

Measurement of Number Average Molecular Weight and Mass Average Molecular Weight In all synthesis examples, number average molecular weight and mass average molecular weight were measured under the following conditions.

Instrument: HLC-8220GPC (from Tosoh Corporation)

Columns: TSKgel SuperHZM-M×3

Temperature: 40° C.

Solvent: THF (Tetrahydrofuran)

Flow rate: 0.35 mL/min

Sample concentration: 0.05%-0.6%, Injection amount: 0.01 ml

A number average or mass average molecular weight was determined by comparing a molecular weight distribution obtained under the above conditions with a molecular weight calibration curve complied with monodisperse polystyrene standard samples. The monodisperse polystyrene standard samples include ten samples each having a molecular weight within a range of from 5.8×100 to 7.5×1,000,000.

Measurement of Acid Value

In all synthesis examples, acid values were measured in the following manner.

First, 1 to 1.5 g of a sample was precisely weighed in a conical flask. Further, 20 mL of xylene was poured into the conical flask, and the sample was dissolved in the xylene by application of heat. Next, 20 mL of dioxane was poured into the conical flask. The resulting solution was titrated with an N/10 potassium hydroxide standard methanol solution, along with a 1% phenolphthalein solution as an indicator, as soon as possible, before the solution became cloudy. At the same time, a blank titration was also conducted.

$$\text{Acid Value}=[5.61-(A-B)\times f]/S$$

wherein A represents an amount (mL) of the N/10 potassium hydroxide standard methanol solution used for the titration, B represents an amount (mL) of the N/10 potassium hydroxide standard methanol solution used for the blank titration, f represents a factor of the N/10 potassium hydroxide standard methanol solution, and S (g) represents a weight of the sample.

Preparation of Prepolymer 1

In a reaction vessel equipped with a condenser, a stirrer, and a nitrogen inlet pipe, 685 parts of ethylene oxide 2 mol adduct of bisphenol A, 80 parts of propylene oxide 2 mol adduct of bisphenol A, 282 parts of terephthalic acid, 24 parts of trimellitic anhydride, and 2 parts of dibutyltin oxide were subjected to a reaction at 230° C. for 7 hours under normal pressures and subsequent 4 hours under reduced pressures of 10 to 15 mmHg. Thus, an intermediate polyester 1 was prepared. The intermediate polyester 1 had a number average molecular weight of 1,980, a mass average molecular weight of 9,100, a glass transition temperature of 54° C. (measured by a differential scanning calorimeter DSC6200 available from Seiko Instruments Inc.), an acid value of 0.6 mgKOH/g, and a hydroxyl value of 47 mgKOH/g.

In another reaction vessel equipped with a condenser, a stirrer, and a nitrogen inlet pipe, 409 parts of the intermediate polyester 1, 89 parts of isophorone diisocyanate, 305 parts of ethyl acetate, and 200 parts of methyl ethyl ketone were subjected to a reaction at 110° C. for 6 hours. Thus, a prepolymer 1 was prepared. The content rate of free isocyanates in the prepolymer 1 was 1.2%.

Measurement of Hydroxyl Value

In all synthesis examples, hydroxyl values were measured in the following manner.

Hydroxy values were measured based on a method according to JIS K0070-1966 as follows.

First, 0.5 g of the intermediate polyester 1 was precisely weighed in a 100-mL measuring flask and 5 mL of an acetylating reagent was further added to the flask. The flask was heated in a bath having a temperature of 100±5° C. After 1 to 2 hours of the heating, the flask was taken out of the bath and left to cool. The flask was then charged with water and shaken well so that the produced acetic acid was decomposed. To complete the decomposition, the flask was heated again in the bath for at least 10 minutes and left to cool. The wall of the flask was well washed with an organic solvent thereafter. The resulting liquid was potentiometrically titrated with an N/2 potassium hydroxide ethyl alcohol solution using an automatic potentiometric titrator (DL-53 Titrator available from Mettler-Toledo International Inc.) to measure a hydroxyl value.

Preparation of Aqueous Phase

An aqueous phase 1 was prepared by mixing 970 parts of ion-exchange water, 40 parts of a 25% aqueous dispersion of a copolymer of styrene, methacrylic acid, butyl acrylate, and methacrylic acid ethylene oxide adducted sodium sulfate, 140 parts of a 48.5% aqueous solution of dodecyl diphenyl ether sodium disulfonate (ELEMINOL MON-7 available from Sanyo Chemical Industries, Ltd.), and 90 parts of a mixture liquid of ethyl acetate and methyl ethyl ketone (60%/40%). The aqueous phase 1 was a milky white liquid.

Preparation of Master Batch 1

A master batch 1 was prepared by mixing 30 parts of water, 40 parts of a carbon black (REGAL 400R available from Cabot Corporation), and 60 parts of a polyester resin (RS-801 available from Sanyo Chemical Industries, Ltd., having a mass average molecular weight of 20,000 and a glass transition temperature of 64° C.) with a HENSCHEL MIXER (product of Mitsui Mining and Smelting Co., Ltd.), kneading the mixture with a double roll at 130° C. for 45 minutes, extending the kneaded mixture while cooling, and pulverizing the extended mixture with a pulverizer into pieces having a size of 1 mm.

Preparation of Oil Phase

In a vessel equipped with a stirrer and a thermometer, 545 parts of the polyester 1, 181 parts of the ester wax 5 as a release agent, and 1,450 parts of a mixture liquid of ethyl acetate and methyl ethyl ketone (60%/40%) were heated to 80° C., kept at 80° C. for 5 hours, and thereafter cooled to 30° C. over a period of 1 hour, while being stirred. Next, 500 parts of the master batch 1 and 100 parts of the mixture liquid of ethyl acetate and methyl ethyl ketone (60%/40%) were put in the vessel and mixed with the vessel contents for 1 hour. Thus, a raw material liquid 1 was prepared.

The raw material liquid 1 in an amount of 1,500 parts was transferred in another vessel and subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes), thus dispersing the carbon black and the wax in the raw material liquid 1.

Next, 425 parts of the polyester 1 and 230 parts of the mixture liquid of ethyl acetate and methyl ethyl ketone (60%/40%) were put in the vessel, and the vessel contents were subjected to the dispersion treatment for once (1 pass). Thus, a colorant-wax dispersion liquid 1 was prepared. The solid content concentration of the colorant-wax dispersion liquid 1 was adjusted to 50% by mixing the mixture liquid of ethyl acetate and methyl ethyl ketone (60%/40%) therein. Thus, an oil phase 1 was prepared.

Granulation of Mother Toner Particles

First, 975 parts of the oil phase 1 and 2.6 parts of isophoronediamine (as an amine) were mixed. Next, 88 parts of the prepolymer 1 was further mixed therein with a TK HOMOMIXER (available from Primix Corporation) at a revolution of 5,000 rpm for 1 minute. Further, 1,200 parts of the aqueous phase 1 was mixed therein with a TK HOMOMIXER at a revolution of 8,000 to 13,000 rpm for 20 minutes. Thus, an emulsion slurry 1 was prepared.

Solvent Removal

The emulsion slurry 1 was put in a vessel equipped with a stirrer and a thermometer and subjected to a solvent removal at 30° C. for 8 hours. Thus, a dispersion slurry 1 was prepared.

Washing and Drying

The dispersion slurry 1 in an amount of 10 parts was filtered under reduced pressures and thereafter subjected to washing and drying processes in the following manner.

(1) The filter cake was mixed with 100 parts of ion-exchange water using a TK HOMOMIXER at a revolution of 12,000 rpm for 10 minutes and thereafter filtered.

(2) The filter cake obtained in (1) was mixed with 100 parts of a 10% aqueous solution of sodium hydroxide using a TK HOMOMIXER at a revolution of 12,000 rpm for 30 minutes and thereafter filtered under reduced pressures.

(3) The filter cake obtained in (2) was mixed with 100 parts of 10% aqueous solution of hydrochloric acid using a TK HOMOMIXER at a revolution of 12,000 rpm for 10 minutes and thereafter filtered.

(4) The filter cake obtained in (3) was mixed with 300 parts of ion-exchange water using a TK HOMOMIXER at a revolution of 12,000 rpm for 10 minutes and thereafter filtered. This operation was repeated twice. Thus, a filter cake 1 was obtained.

The filter cake 1 was dried by a circulating air dryer at 40° C. for 48 hours and sieved with a mesh having an opening of 75 μm. Thus, a mother toner particle 5 having a particle diameter of 6.0 μm was prepared. The mother toner particle 5 had an average circularity of 0.960.

The mother toner particle 5 in an amount of 150 g was mixed with 1.4 g of a silica particle and 1.2 g of a titanium oxide particle using a 2-L HENSCHEL MIXER at a peripheral speed of 40 m/sec for 6 minutes, so that the silica particle and the titanium oxide particle were externally added to the surface of the mother toner particle. Thus, a toner was prepared.

The content rate of aliphatic alcohols having 18 to 22 carbon atoms in the toner was 0.009%, measured by the GC-MS analysis.

Preparation of Two-Component Developer

The toner in an amount of 7 parts and a carrier having a weight average particle diameter of 34 μm and a silicone coating layer having an average thickness of 0.6 μm in an amount of 100 parts were contained in a container. The container was subjected to an agitation by a TURBULA MIXER that causes the container to undergo rolling motion, so that the toner and the carrier in the container were stirred, uniformly mixed, and charged. Thus, a two-component developer was prepared.

The developer and toner were mounted on a multifunction peripheral AFICIO SP C831DN (product of Ricoh Co., Ltd.) which had been modified such that the fixing temperature was 3° C. higher than the initial setting. The multifunction peripheral was put in a tester (having a chamber having a volume of 5 $m^3$) located in a testing laboratory of the Blue Angel Mark and subjected to a measurement of the rate of generation of UFP. As a result, the rate of generation of UFP was $2.0\times10^{11}$ particles/10 min.

The rate of generation of UFP was measured using a Fast Mobility Particle Sizer (FMPS) Model 3091 (product of TSI) based on a method according to RAL-UZ 171.

Comparative Example II-2 and Example II-5

The procedure in Example II-2 was repeated except for replacing the ester wax 5 with the ester wax 1 (in Comparative Example II-2) or the ester wax 2 (in Example II-5). Thus, a toner 6 and a two-component developer 6 were prepared in Comparative Example II-2, and a toner 7 and a two-component developer 7 were prepared in Example II-5. The rates of generation of UFP for the two-component developers 6 and 7, measured with the modified multifunction peripheral AFICIO SP C831DN, were $5.4\times10^{11}$ particles/10 min and $3.2\times10^{11}$ particles/10 min, respectively.

Example II-6

The procedure in Example II-5 was repeated except for changing the formulation of mother toner particle as follows, to prepare a toner 8.

Formulation of Mother Toner Particle

Polyester resin (having a weight average molecular weight of 68,200 and a glass transition temperature (Tg) of 65.6° C.): 100 parts Colorant (Carbon black): 10 parts Release agent (Ester wax 7): 7.8 parts Charge controlling agent (Monoazo Fe metal complex): 2 parts The content rate of aliphatic alcohols having 18 to 22 carbon atoms in the toner was 0.19% by mass.

A two-component developer was prepared using this toner in the same manner as in Example II-1. As a result, the rate of generation of UFP was $3.4\times10^{11}$ particles/10 min.

Example II-7

Unmodified Polyester

Synthesis of Unmodified Polyester 101

In a reaction vessel equipped with a condenser, a stirrer, and a nitrogen inlet pipe, 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide were subjected to a reaction at 230° C. for 8 hours under normal pressures and subsequent 5 hours under reduced pressures of 10 to 15 mmHg. After 45 parts of trimellitic anhydride was further added to the reaction vessel, the vessel contents were subjected to a reaction at 180° C. for 2 hours under normal pressures. Thus, an unmodified polyester 101 was prepared.

The unmodified polyester 101 had a number average molecular weight of 2,500, a weight average molecular weight of 6,700, a glass transition temperature of 43° C., and an acid value of 26.2 mgKOH/g.

NCO-Modified Polyester

Synthesis of Isocyanate-modified Polyester 101

In a reaction vessel equipped with a condenser, a stirrer, and a nitrogen inlet pipe, 682 parts of ethylene oxide 2 mol adduct of bisphenol A, 81 parts of propylene oxide 2 mol adduct of bisphenol A, 290 parts of terephthalic acid, 9 parts of trimellitic anhydride, and 2 parts of dibutyltin oxide were subjected to a reaction at 230° C. for 8 hours under normal pressures and subsequent 8 hours under reduced pressures of 10 to 15 mmHg. Thus, an intermediate polyester 101 was prepared.

In another reaction vessel equipped with a condenser, a stirrer, and a nitrogen inlet pipe, 453 parts of the intermediate polyester 101, 41 parts of isophorone diisocyanate, and 500 parts of ethyl acetate were subjected to a reaction at 100° C. for 5 hours. Thus, an ethyl acetate solution of an isocyanate-modified polyester 101 (having a solid content concentration of 50%) was prepared.

The isocyanate-modified polyester 101 had a number average molecular weight of 3,200, a weight average molecular weight of 14,400, and an NCO content rate of 0.76%.

Preparation of Master Batch 101

First, 40 parts of a carbon black (REGAL® 400R from Cabot Corporation), 60 parts of the unmodified polyester 101, and 30 parts of water were mixed by a HENSCHEL MIXER to obtain a mixture that is a colorant aggregation impregnated with water. The mixture was kneaded with a double roll having a surface temperature of 130° C. for 45 minutes. The kneaded mixture was pulverized into pieces having a size of 1 mm by a pulverizer. Thus, a master batch 101 was prepared.

Preparation of Colorant-Wax Dispersion Liquid (Oil Phase)

In a vessel equipped with a stirrer and a thermometer, 545 parts of the unmodified polyester 101, 181 parts of the ester wax 4, and 1,450 parts of ethyl acetate were heated to 80° C., kept at 80° C. for 5 hours, and thereafter cooled to 30° C. over a period of 1 hour, while being stirred. Next, 500 parts of the master batch 101 and 100 parts of ethyl acetate were put in the vessel and mixed with the vessel contents for 1 hour. Thus, a raw material liquid 101 was prepared.

The raw material liquid 101 in an amount of 1,500 parts was transferred in another vessel and subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes), thus dispersing the carbon black and the wax in the raw material liquid 1. Next, 425 parts of the polyester 1 and 230 parts of the mixture liquid of ethyl acetate and methyl ethyl ketone (60%/40%) were put in the vessel, and the vessel contents were subjected to the dispersion treatment for once (1 pass). Thus, a colorant-wax dispersion liquid 101 was prepared. The solid content concentration (at 130° C., 30 minutes) of the colorant-wax dispersion liquid 101 was adjusted to 50% by mixing ethyl acetate therein. Thus, an oil phase 101 was prepared.

Preparation of Aqueous Phase

An aqueous phase 101 was prepared by mixing 970 parts of ion-exchange water, 40 parts of a 25% by mass aqueous dispersion of an organic resin particle (i.e., a copolymer of styrene, methacrylic acid, butyl acrylate, and methacrylic acid ethylene oxide adducted sodium sulfate) for improving dispersion stability, 140 parts of a 48.5% aqueous solution of dodecyl diphenyl ether sodium disulfonate (ELEMINOL MON-7 available from Sanyo Chemical Industries, Ltd.), and 90 parts of ethyl acetate.

Emulsification

First, 975 parts of the oil phase 101 was stirred with a TK HOMOMIXER (product of PRIMIX Corporation) at a revolution of 5,000 rpm for 1 minute. Next, a 2.5% water/ethanol (3/7) mixture solution of sodium was dropped in the oil phase 101 and mixed therein at a revolution of 5,000 rpm for 1 minute, so that the resulting emulsion had a particle size of about 4 to 5 microns. Finally, 88 parts of the isocyanate-modified polyester 101 was mixed therein using a TK HOMOMIXER (product of PRIMIX Corporation) at a revolution of 5,000 rpm for 1 minute, and 1,200 parts of the aqueous phase 101 was further mixed therein using a TK HOMOMIXER at a revolution of 8,000 to 13,000 rpm for 20 minutes. Thus, an emulsion slurry 101 was prepared.

Solvent Removal

The emulsion slurry 101 was put in a vessel equipped with a stirrer and a thermometer and subjected to a solvent removal at 30° C. for 8 hours. Thus, a dispersion slurry 101 was prepared.

Washing and Drying

After 100 parts of the dispersion slurry 101 was filtered under reduced pressures:

(1) The filter cake was mixed with 100 parts of ion-exchange water using a TK HOMOMIXER at a revolution of 12,000 rpm for 10 minutes and thereafter filtered. The filtrate was milky white.

(2) The filter cake obtained in (1) was mixed with 900 parts of ion-exchange water using a TK HOMOMIXER at a revolution of 12,000 rpm for 30 minutes, while ultrasonic vibration was applied thereto, and thereafter filtered. This operation was repeated until the electric conductivity of the re-slurry liquid falls below 10 μC/cm.

(3) A 10% solution of hydrochloric acid was mixed with the re-slurry liquid obtained in (2). The mixture was stirred by a THREE-ONE MOTOR for 30 minutes and thereafter filtered.

(4) The filter cake obtained in (3) was mixed with 100 parts of ion-exchange water using a TK HOMOMIXER at a revolution of 12,000 rpm for 10 minutes and thereafter filtered. This operation was repeated until the electric conductivity of the re-slurry liquid falls below 10 μC/cm. Thus, a filter cake 101 was obtained.

The filter cake 101 was dried by a circulating air dryer at 42° C. for 48 hours and sieved with a mesh having an opening of 75 μm. Thus, a mother toner 9 was prepared. The mother toner 9 had an average circularity of 0.972, a volume average particle diameter (Dv) of 5.8 μm, a number average particle diameter (Dp) of 5.1 μm, and a particle size distribution (Dv/Dp) of 1.16. The mother toner 9 in an amount of 100 parts was mixed with 1.8 parts of a hydrophobic silica using a HENSCHEL MIXER. Thus, a toner 9 was prepared.

The content rate of aliphatic alcohols having 18 to 22 carbon atoms in the toner 9 was 0.060% by mass.

Example II-8

The procedure in Example II-7 was repeated except for replacing the ester wax 4 with the ester wax 8. Thus, a toner 10 was prepared.

No aliphatic alcohol having 18 to 22 carbon atoms was detected from the toner 10.

Comparative Example II-3

The procedure in Example II-7 was repeated except for replacing the ester wax 4 with the ester wax 1. Thus, a toner 11 was prepared.

The content rate of aliphatic alcohols having 18 to 22 carbon atoms in the toner 11 was 0.25% by mass.

The toners 9 to 11 were subjected to a measurement of rate of generation of UFP, as one-component developers, in the following manner.

A monochrome electrophotographic laser printer RICOH SP 4510 (product of Ricoh), employing a one-component developing method, was modified such that the temperature of the filing roll was 18° C. higher than the initial setting. Each of the toners 9 to 11 was mounted on the modified laser printer and subjected to the measurement of rate of generation of UFP. As a result, the rates of generation of UFP for the toners 9 to 11 were $3.3\times10^{11}$ particles/10 min, $2.2\times10^{11}$ particles/10 min, and $6.1\times10^{11}$ particles/10 min, respectively, when measured in the same manner as in Example II-1.

Additionally, after being stored in an environment of 35° C. and 45% RH for 120 hours, each of the toners 9 to 11 was mounted on the modified laser printer. The laser printer was caused to print images on 2,000 sheets, and the 2,000th image was observed to evaluate image quality. As a result, the 2,000th image formed with the toner 9 and 11 were each high in image quality. In the 2,000th image formed with the toner 10, strip-like image defect was slightly observed, which was an acceptable level in practical use. The toner 10 contains no aliphatic alcohol having 18 to 22 carbon atoms and the rate of generation of UFP is low. However, strip-like image was slightly observed in the image, since a slight amount of organic acids was remaining.

TABLE 2

| | Two-component Developer No. | Toner No. | Mother Toner Particle No. | Ester Wax No. | Toner Average Circularity | Content Rate of C18-C22 Aliphatic Alcohols in Toner (% by mass) | Rate of Generation of UFP (particles/10 min) |
|---|---|---|---|---|---|---|---|
| Comparative Example II-1 | 1 | 1 | 1 | 1 | 0.930 | 0.27 | $5.5 \times 10^{11}$ |
| Example II-1 | 2 | 2 | 2 | 4 | | 0.050 | $3.1 \times 10^{11}$ |
| Example II-2 | 3 | 3 | 3 | 5 | | 0.010 | $1.9 \times 10^{11}$ |
| Example II-3 | 4 | 4 | 4 | 6 | | 0.007 | $2.3 \times 10^{11}$ |
| Example II-4 | 5 | 5 | 5 | 5 | 0.960 | 0.009 | $2.0 \times 10^{11}$ |
| Comparative Example II-2 | 6 | 6 | 6 | 1 | 0.930 | 0.27 | $5.4 \times 10^{11}$ |
| Example II-5 | 7 | 7 | 7 | 2 | 0.930 | 0.11 | $3.2 \times 10^{11}$ |
| Example II-6 | 8 | 8 | 8 | 7 | 0.935 | 0.19 | $3.4 \times 10^{11}$ |
| Example II-7 | 9 | 9 | 9 | 4 | 0.972 | 0.060 | $3.3 \times 10^{11}$ |
| Example II-8 | 10 | 10 | 10 | 8 | 0.972 | Undetected | $2.2 \times 10^{11}$ |
| Comparative Example II-3 | 11 | 11 | 11 | 1 | 0.972 | 0.25 | $6.1 \times 10^{11}$ |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A toner, comprising:

an ester wax, wherein the ester wax comprises:

a long-chain aliphatic ester represented by the following formula:

R—COO—R', in which:

R represents an alkyl group having 13 to 23 carbon atoms, and

R' represents an alkyl group having 18 to 22 carbon atoms; and an aliphatic alcohol having 18 to 22 carbon atoms in an amount of 0.01% by mass to 0.20% by mass based on a total mass of the toner.

2. The toner of claim 1, wherein the amount of the aliphatic alcohol having 18 to 22 carbon atoms in the toner is from 0.01% by mass to 0.15% by mass based on the total mass of the toner.

3. The toner of claim 1, further comprising:

a urea-modified polyester as a binder resin.

4. The toner of claim 3, wherein:

the binder resin further comprises an unmodified polyester; and a mass ratio of the urea-modified polyester to the unmodified polyester ranges from 5/95 to 30/70.

5. The toner of claim 3, wherein:

the urea-modified polyester has urethane bonds and urea bonds; and a molar ratio of a content of the urea bonds to a content of the urethane bonds ranges from 80/20 to 20/80.

6. The toner of claim 1, wherein the toner is a pulverization toner.

7. The toner of claim 1, wherein the toner is a polymerization toner.

8. The toner of claim 1, wherein the amount of the aliphatic alcohol having 18 to 22 carbon atoms in the toner is from 0.010% to 0.060% by mass based on the total mass of the toner.

9. The toner of claim 3, wherein the urea-modified polyester has a number average molecular weight from 1,000 to 10,000.

10. A developer, comprising the toner of claim 1.

11. A toner storing unit, comprising:

a storing unit; and the toner of claim 1 stored in the storing unit.

12. An image forming apparatus, comprising:

an electrostatic latent image bearer;

an electrostatic latent image forming device configured to form an electrostatic latent image on the electrostatic latent image bearer; and a developing device comprising the developer of claim 10, configured to develop the electrostatic latent image formed on the electrostatic latent image bearer into a toner image with the developer.

* * * * *